US011832656B2

(12) United States Patent
Shekhani

(10) Patent No.: US 11,832,656 B2
(45) Date of Patent: Dec. 5, 2023

(54) INFANT SLEEP GARMENT WITH TRIANGLE SLEEVES AND METHODS THEREOF

(71) Applicant: TWO BABY BEARS AND CO. LLC, Ballwin, MO (US)

(72) Inventor: Ummekulsoom Shekhani, Ballwin, MO (US)

(73) Assignee: Two Baby Bears and Co. LLC, Ballwin, MO (US)

( * ) Notice: Subject to any disclaimer, the term of this patent is extended or adjusted under 35 U.S.C. 154(b) by 371 days.

(21) Appl. No.: 17/068,384

(22) Filed: Oct. 12, 2020

(65) Prior Publication Data

US 2021/0030075 A1 Feb. 4, 2021

Related U.S. Application Data

(63) Continuation of application No. 17/068,316, filed on Oct. 12, 2020, which is a continuation-in-part of application No. 16/577,448, filed on Sep. 20, 2019, now Pat. No. 11,350,677.

(60) Provisional application No. 63/057,899, filed on Jul. 29, 2020, provisional application No. 62/733,637, filed on Sep. 20, 2018.

(51) Int. Cl.
*A41B 13/06* (2006.01)

(52) U.S. Cl.
CPC ..... *A41B 13/06* (2013.01)

(58) Field of Classification Search
CPC ..... A41B 13/00; A41B 13/005; A41B 13/06
See application file for complete search history.

(56) References Cited

U.S. PATENT DOCUMENTS

| | | | | |
|---|---|---|---|---|
| 5,226,193 | A | 7/1993 | Chen | |
| 5,618,263 | A | 4/1997 | Alivizatos | |
| 7,954,187 | B1 | 6/2011 | Earnest | |
| 8,375,486 | B2 | 2/2013 | Earnest | |
| 9,003,564 | B2 | 4/2015 | Wynh | |
| 9,060,549 | B2 | 6/2015 | Buckson | |
| 9,179,711 | B2 | 11/2015 | Krawchuk | |
| 10,104,916 | B2 * | 10/2018 | Barski | A41B 13/06 |
| 2011/0180079 | A1 | 7/2011 | Krawchuk | |
| 2011/0191932 | A1 | 8/2011 | Earnest | |
| 2013/0283527 | A1 | 10/2013 | Houston et al. | |

(Continued)

OTHER PUBLICATIONS

Non-Final Office Action regarding U.S. Appl. No. 16/577,448 dated Sep. 1, 2021, 16 pages.

*Primary Examiner* — Keri J Nelson
(74) *Attorney, Agent, or Firm* — POLSINELLI PC

(57) ABSTRACT

Described herein is an infant or toddler sleep device or accessory in the form of a garment with two detachable or non-removable weighted sleeves—one for each arm—to provide gentle pressure on the infant's arms to reduce the moro (startle) reflex. This device safely mimics the swaddling effect by adequately reducing the startle reflex and flailing of arms and safely exerting the benefits of deep pressure touch stimulation (DPST) without weighing down the infant's torso, thus helping baby sleep safely for longer periods of time. The weighted sleeves may be removed once the startle reflex decreases in intensity and the infant/toddler can still continue to wear the sleep garment to sleep. The sleep device may eliminate the risk of suffocation or overheating that other swaddle or swaddle transition garments or devices might pose.

11 Claims, 24 Drawing Sheets

(56) References Cited

U.S. PATENT DOCUMENTS

| | | | | |
|---|---|---|---|---|
| 2015/0000036 | A1 | 1/2015 | Krawchuk | |
| 2016/0128392 | A1 | 5/2016 | Krawchuk | |
| 2016/0362024 | A1 | 12/2016 | Simon et al. | |
| 2018/0168240 | A1 | 6/2018 | Parker | |
| 2019/0069609 | A1 | 3/2019 | Blackburn | |
| 2020/0196685 | A1* | 6/2020 | Williams | A47G 9/083 |
| 2020/0397066 | A1* | 12/2020 | Sheppard | A61J 17/02 |

* cited by examiner

INFANT SLEEP GARMENT WITH TRIANGLE SLEEVES AND METHODS THEREOF

CROSS REFERENCE TO RELATED APPLICATIONS

This application is a continuation of U.S. patent application Ser. No. 17/068,316 filed on Oct. 12, 2020 which claims priority to U.S. Patent Application Ser. No. 63/057,899, filed on Jul. 29, 2020, and is a continuation-in-part of U.S. patent application Ser. No. 16/577,448, filed on Sep. 20, 2019, which claims priority to U.S. Patent Application Ser. No. 62/733,637, filed on Sep. 20, 2018, the entire contents of which are hereby incorporated by reference.

FIELD

The present subject matter relates to infant sleepwear, specifically infant sleepwear garments and devices for safe and healthy sleep.

BACKGROUND

Current infant sleep safety guidelines released by the AAP (American Academy of Pediatrics) state that infants should be placed on their backs to sleep in a crib free of blankets, bumpers, plush toys, and other items. Ideally, the guidelines state that babies should share a room with their parents for the first six months to a year of their lives, use a pacifier as a sleep aid, and have a fan for circulating air in the room to help reduce the risk of SIDS (Sudden Infant Death Syndrome). Studies show that the campaigns promoting recent guidelines has in fact reduced the occurrence of SIDS significantly within the last few decades.

However, it has been shown that many infants dislike sleeping on their backs and would much rather sleep more comfortably on their sides or stomach. The cause isn't exactly known, but it is speculated that this may be because of the baby's positioning in the womb, or because of the way humans have evolved over generations, or simply because babies prefer the feeling of snugness that the side laying or belly-down positions provide. This dilemma has been solved by the time-tested practice of swaddling.

Swaddling is the art of wrapping a baby snugly in a blanket (or similar material) with arms straight at their sides so that their extremities are controlled and restricted in movement. To swaddle an infant safely and satisfactorily, one must make sure that the infant's arms are properly immobilized but that the legs and hips are still given some access to horizontal and vertical movement. Swaddling provides babies with the snug, close-fitting environment newborns need and mimics womb-like sensations, and thus inhibits the moro (startle) reflex. Usually, if a baby is not swaddled or swaddled incorrectly, this innate sudden jerking movement or twitching of the arms startles the baby awake repeatedly, leading to little or poor quality sleep for the infant and parents, which is not sustainable in the long term for either party's mental or physical health and well-being.

Although it seems simple in theory, swaddling a baby correctly is something many parents struggle with. Parents not only need to worry about making sure that they have swaddled their baby tightly enough so that the arms can't escape and therefore loosen and unravel the swaddle, but they also have to make sure that the swaddle is not too tight around the hips, legs, and chest, thus affecting breathability or risking hip dysplasia; or swaddling the infant in a blanket or fabric that does not provide proper ventilation and cause baby to overheat. In addition to the above, many parents aren't familiar with different swaddling techniques and end up prematurely discarding the swaddle and its numerous benefits because the baby continuously wriggles free of the confines of the swaddle. This presents another significant problem: the fabric of the swaddle covering the neck and face of the infant and presenting a suffocation hazard. For younger babies, this is not too much of a risk, as they usually do not yet have the strength to break their arms out of the swaddle, but as the baby reaches one month of age, this lack of ability to properly swaddle ends up compromising the same rules that were put in place by the AAP to reduce the number of SIDS' related deaths.

Because of the difficulties mentioned above, many caregivers initially try to swaddle their baby for the first several weeks, but then are quickly forced to abandon the practice and incorrectly believe that their baby just does not like being swaddled, or that their baby is a swaddle "Houdini," and simply cannot be soothed using the age-old, time-tested formula.

To combat the numerous issues mentioned above in regards to the difficulties in being able to swaddle an infant properly, safely, and effectively, different solutions have been devised and are found in the current retail market—solutions such as swaddle pods, swaddle sacks, swaddle straps, and sleep suits (some zippered and some secured with a hook and loop mechanism), which replace the conventional blanket swaddle. All of these swaddle garments solve one or more of the difficulties that were cited earlier, but simultaneously present other substantial risks or issues (such as overheating, suffocation hazard due to Velcro closure, more freedom of movement for arms, etc.). Due to SIDS' concerns, infants are required to be out of the swaddle once they start rolling over in order to prevent suffocation. All of the swaddles available on the market focus on transitioning the infant out of the swaddle by either taking one arm out at a time, or by completely removing the suit due to concerns of rolling over and suffocating, thus leaving the baby bereft of the security they've developed over months through the sleep association respective sleep garment. Although there are several transitional products available on the market, they either give the baby an elevated amount of freedom to move their limbs or may present potential overheating concerns.

Further, there is no one device that can help infants safely transition out of the swaddle by having the option of trying one product in various different ways. There is also not the option of having one configuration that infants can safely wear well into the toddler years without having to keep changing their sleep garments as they reach different stages of development.

Thus, it would be advantageous to have a swaddle transition device that overcomes the problem of completely eliminating the infant's sleep association that has been established through months of diligent daily swaddle use while also staying true to SIDS' prevention guidelines.

Further, there is also a need for a swaddling device that helps to keep the infant's arms down to suppress baby's startles while still allowing for some movement, and to reduce the risk of overheating.

Therefore, there is a necessity for an infant sleep garment device that addresses the interests and complications cited above, as explained and declared in the succeeding drawings and description.

BRIEF SUMMARY

Described herein is an infant wearable blanket or sleepwear device with detachable sleeves that restrain an infant's arms. The infant swaddle device includes two detachable or non-removable sleeves with the option of being attached to a garment such as a full-body wearable blanket, snug-fitting swaddle device, body suit (with legs exposed/unconfined), full-body pajamas or romper, as an example. In some aspects, the sleeves may be gently—weighted to help reduce the startle reflexes of the infant when around the infant's arm while the infant is sleeping and exerting the benefits of deep pressure touch stimulation (DPST) while promoting ultimate breathability without placing any additional pressure, layers, or weight on the child's torso. In other aspects, the sleeves may be triangle shaped to provide some resistance and help aid in reducing the baby's premature startles but still allow for full extension, contraction, and movement of the arm.

In an aspect, the sleeves may be detachable and removable from the garment via an attachment mechanism, so once the infant is ready for more movement or freedom, caregivers can remove the sleeves and continue using the wearable blanket or sleep garment. For example, the attachment mechanisms may include, but are not limited to hook and loop fasteners, buttons, zippers, or snaps. In an aspect, an upper edge of the sleeve is operable to rest just below the infant's armpit, and a bottom edge of the sleeve is operable to rest just above the infant's wrist or just under the infant's elbow when the sleeve is placed around the infant's arm.

In some aspects, the sleeve further comprises one or more chambers inside the sleeve operable to hold a weighting to help aid in reducing the baby's premature startles. The weighting may include, but is not limited to at least one of a natural or synthetic material, poly beads, glass beans, beans, sand, beads, a polymeric gel, silicone, poly-fill fiber, a layer of fabric, or any combination thereof.

Also provided herein is a method of reducing the startle reflexes of an infant through the use of weighted sleeves in combination with multiple configurations of sleeping garments.

Beyond what is mentioned above, further implementations, advantages, and original features will be explained in the detailed description and drawings that follow.

BRIEF DESCRIPTION OF THE DRAWINGS

The drawings provided herein illustrate two or more realizations of the aforementioned concept, by way of example only, and not by its limitations.

DETAILED DESCRIPTION

Figure 1A:
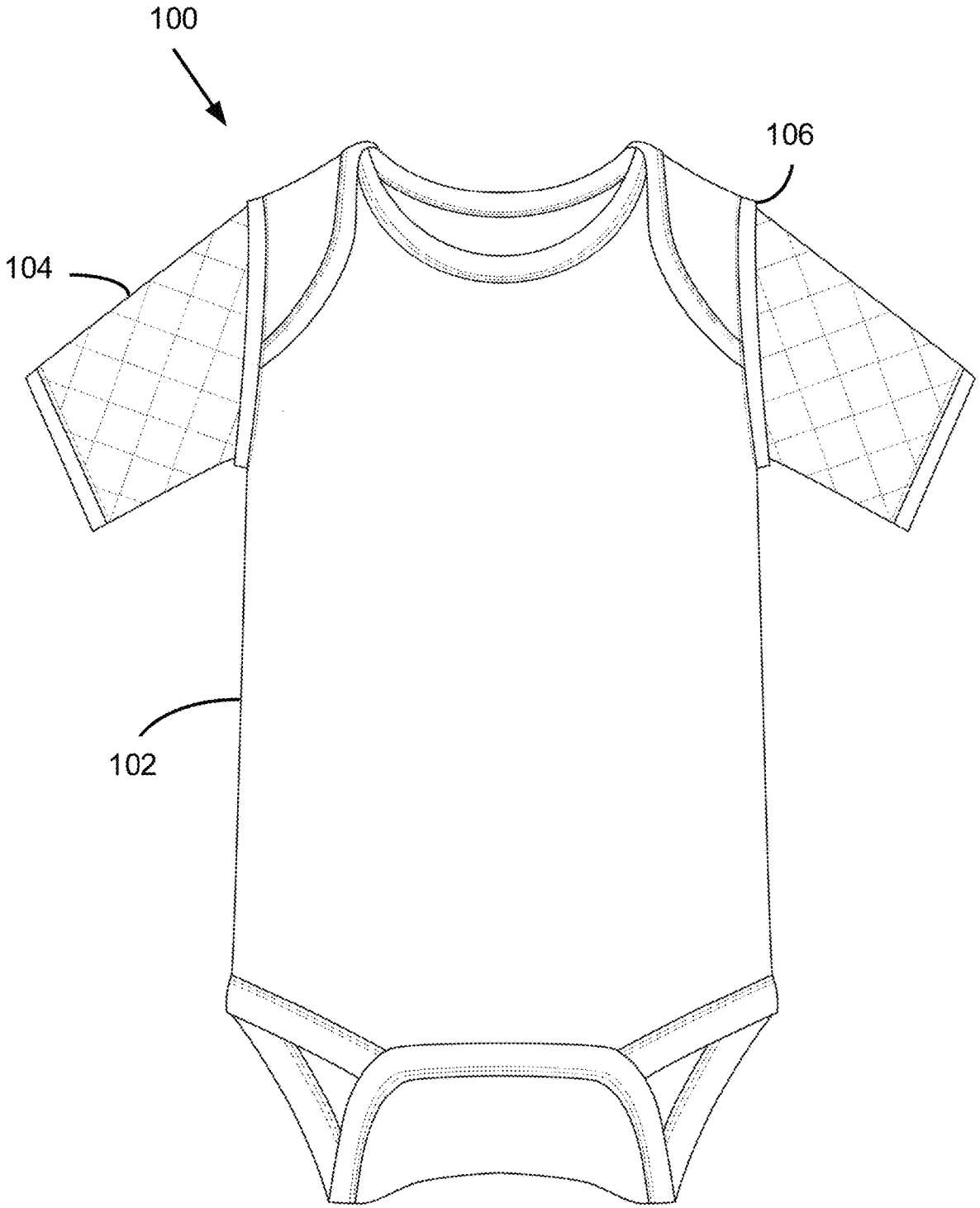
FIG. 1A is a view of the weighted sleeves in quilted pattern on a body suit garment, in an example.
Figure 1B:
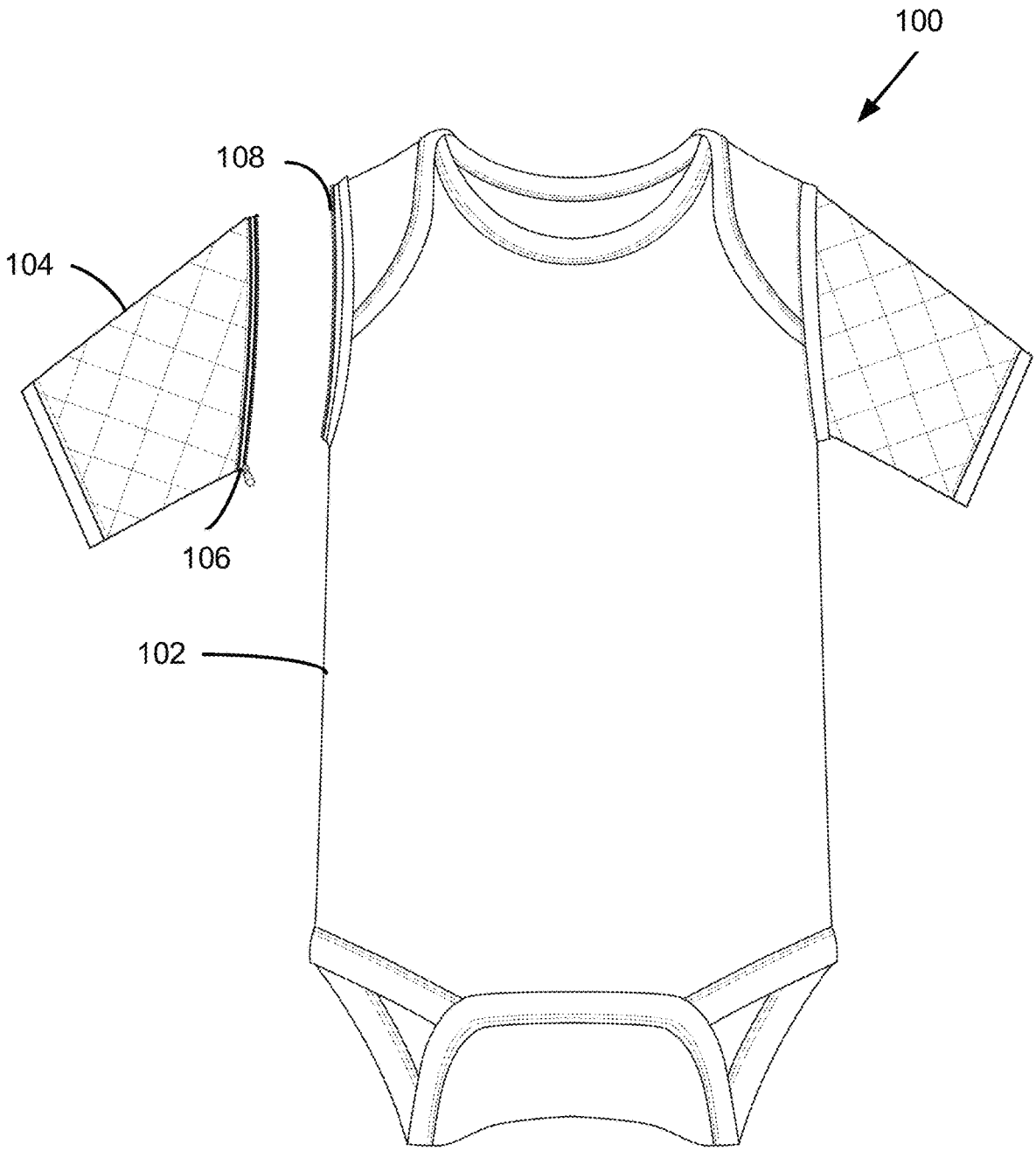
FIG. 1B is a view of the garment of FIG. 1A with a weighted sleeve removed.
Figure 1C:
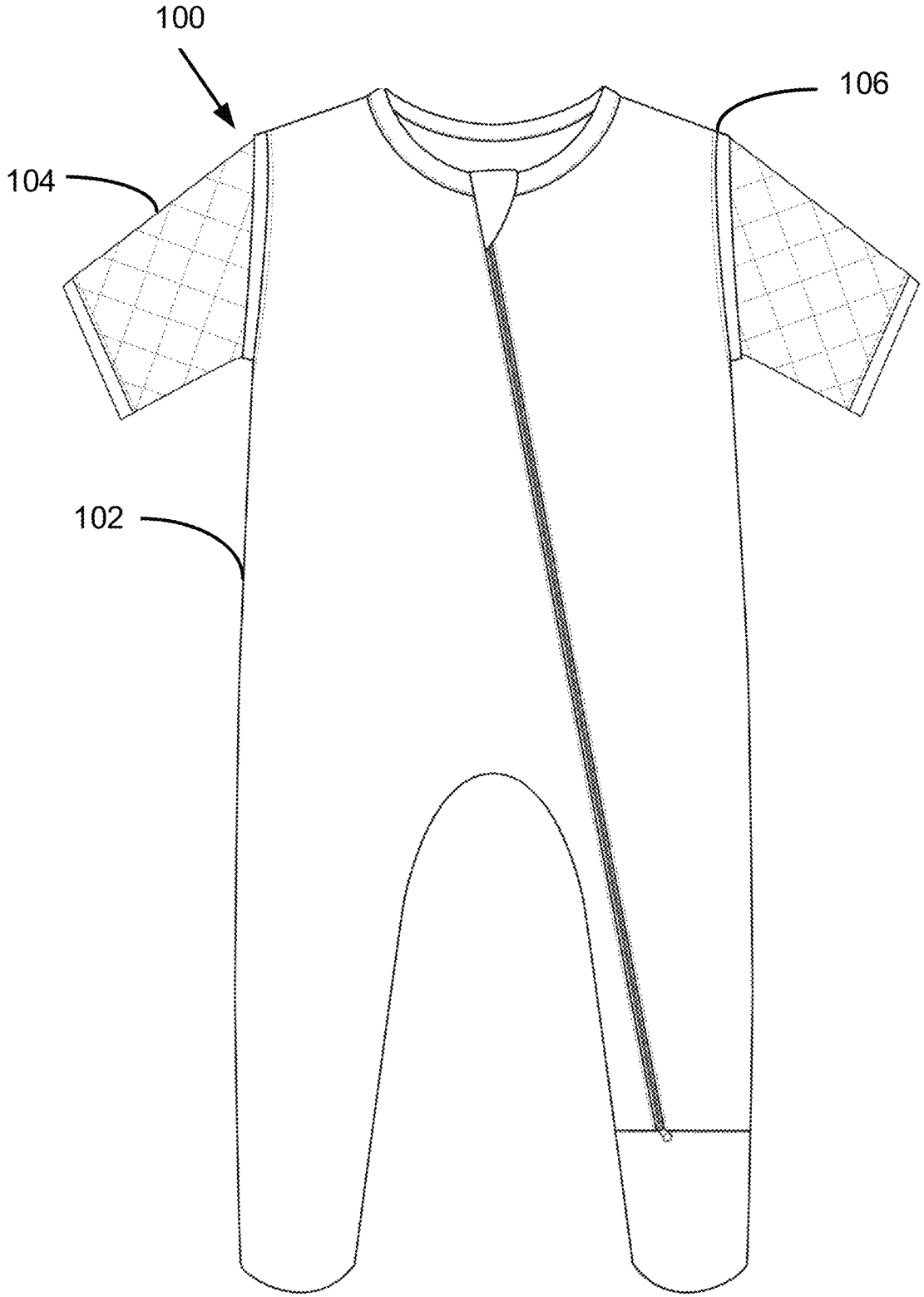
FIG. 1C is a view of the weighted sleeves in a quilted pattern on a full-body pajama garment, in an example.
Figure 1D:
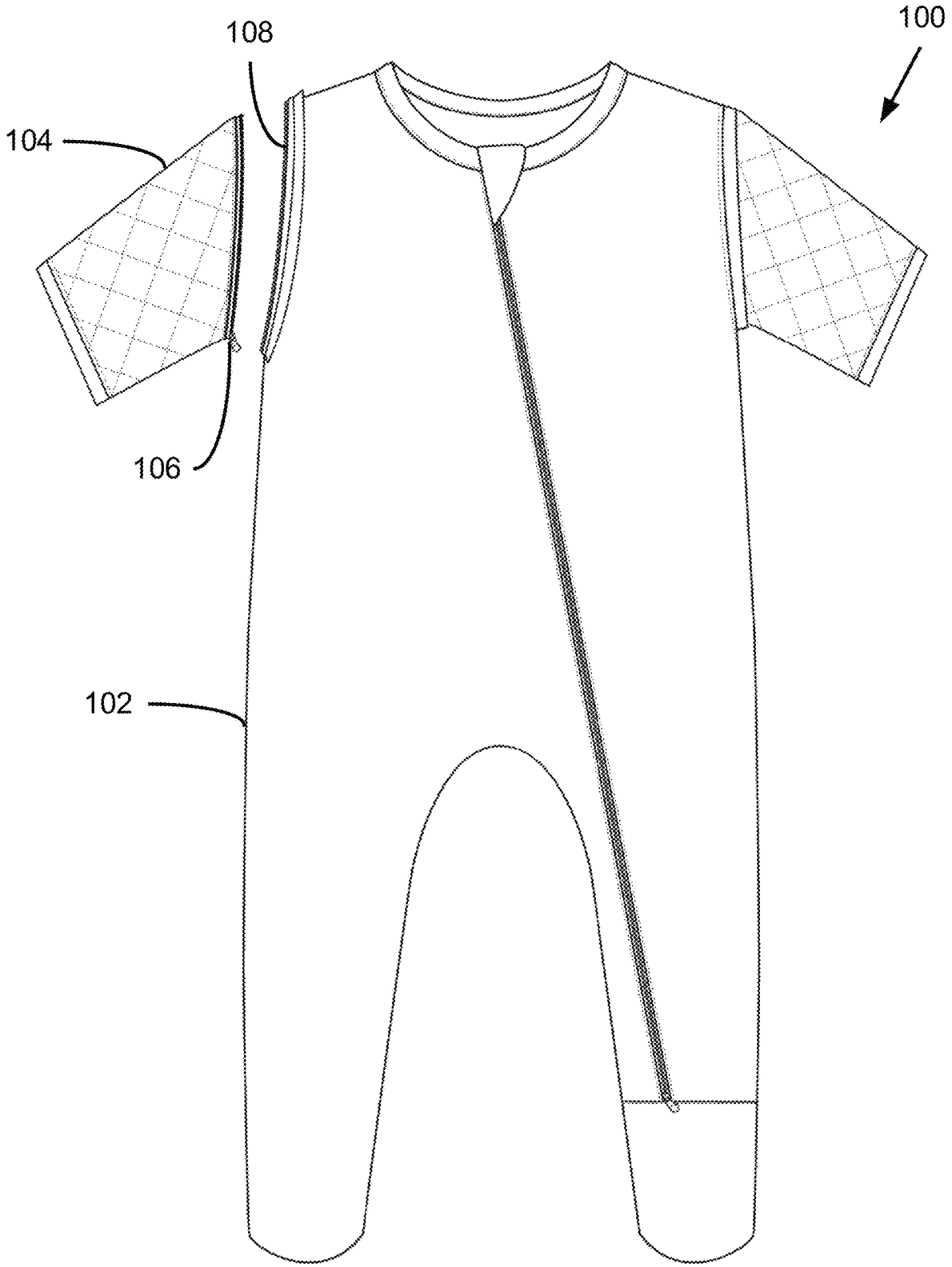
FIG. 1D is a view of the garment of FIG. 1C with a weighted sleeve removed.
Figure 1E:
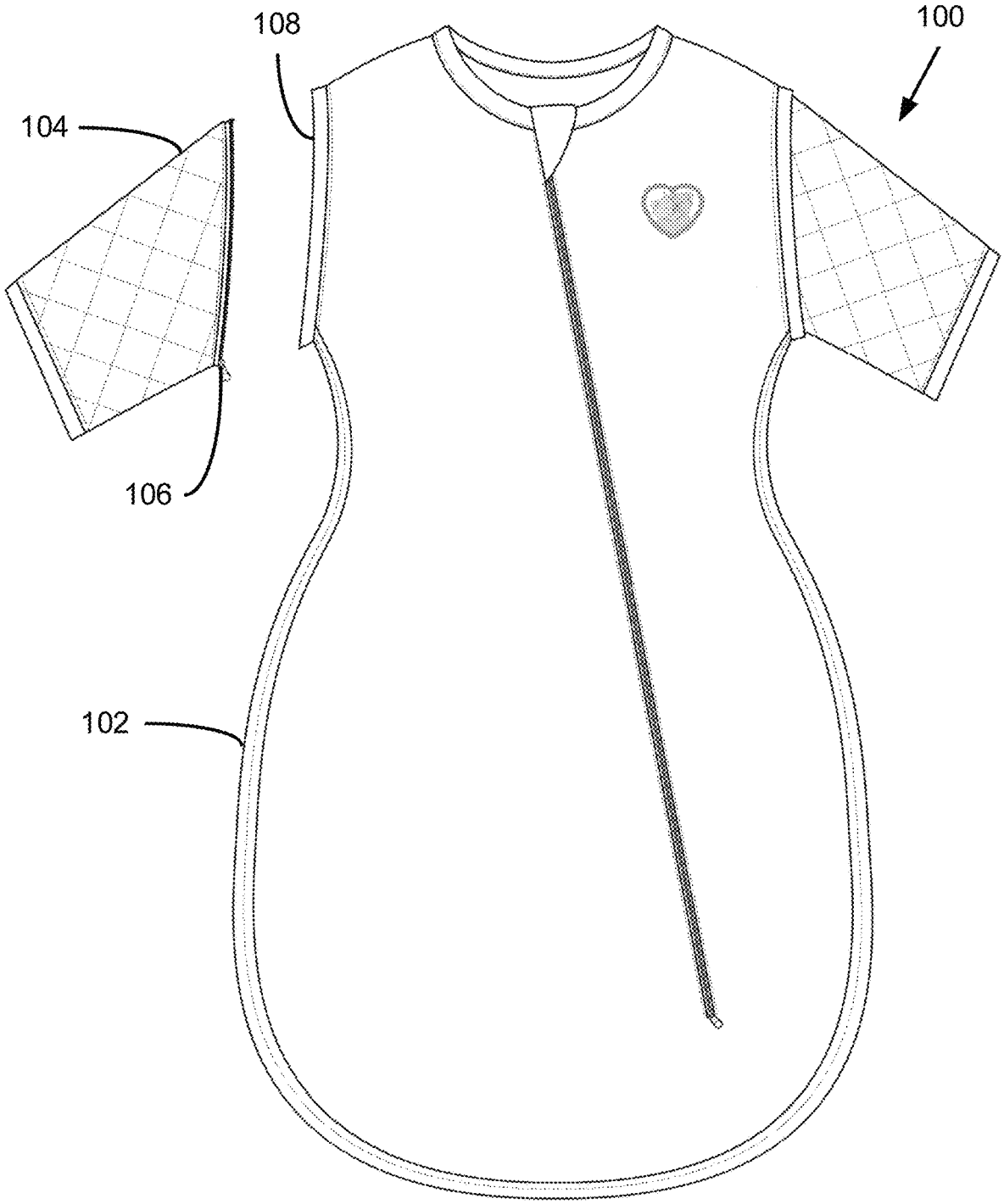
FIG. 1E is a view of the weighted sleeves in quilted pattern on a snug-fitting zippered swaddle garment with a sleeve removed, in an example.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout the above disclosure will now be presented. The term "coupled" is defined as connected, whether directly or indirectly through intervening components, and is not necessarily limited to physical connections. The connection can be such that the objects are permanently connected or reversibly connected. The term "substantially" is defined to be essentially conforming to the particular dimension, shape or other word that substantially modifies, such that the component need not be exact. For example, "substantially rectangular" means that the object resembles a rectangle, but can have one or more deviations from a true rectangle. The terms "comprising," "including" and "having" are used interchangeably in this disclosure. The terms "comprising," "including" and "having" mean to include, but not necessarily be limited to the things so described.

Many infants do not respond well to the transitioning swaddles that are currently available and protest the arms being abruptly unrestrained by not sleeping as well or for as long as normal. Also, as the infant reaches the age (usually around three to four months) during which the swaddle becomes unnecessary but is still used as a sleep crutch and association, parents may desire to move the baby away from the swaddle but in a gentle, coaxing manner, one that does not disrupt the successful routine and sleep patterns already in place.

Provided herein is a sleep devices for infants or toddlers operable to provide a secure, restrained environment to encourage an infant's arms to stay in a downward position, thus inhibiting the moro reflex. The sleep device described herein may be safely and successfully used by infants or be used as a transition device for older babies. For example, the swaddle device may promote safety and ease in current swaddling practices and techniques, with or without the use of a traditional swaddle.

The present sleep device provides an alternative to the traditional infant swaddle or other traditional infant sleep garments in the form of weighted detachable sleeves that can be implemented with any form of a sleeping garment in the configuration of a swaddle, wearable blanket, sleep sack, body suit, full-body pajamas with orifices for each of the limbs, romper with the child's feet exposed, or any other traditionally accepted sleep garment. An advantage of the present device is that it can help to easily transition the infant out of the swaddle or be used as a swaddle alternative for those babies who don't prefer to be traditionally swaddled but still have a strong startle reflex. It fulfills the function of soothing the infant's startles, but with a minimalistic approach. Other advantages include that it does not present a suffocation risk due to the arms being properly and separately restrained, and there is no risk of overheating, since the fabric used in this device is minimal, breathable, and not bulky. Another advantage is that the device can be used from the newborn stage until the baby is transitioning out of the swaddle and beyond, and it can be used for older babies who are stronger as the weighting in the device can be adjustable. Another advantage is that when the infant is ready to be unswaddled, the sleeves may function as a buffer to simply restrain the arms while the rest of the body can be unconstrained in a different rendition of the sleeping garment such as a bodysuit with the child's legs left uncovered.

The sleep device provided herein relates generally to a sleep garment device that restrains the arms of infants gently while providing a secure environment. In some examples, the device may use added weight in the sleeves to promote ease and comfort in sleeping. In other examples, the device may use sleeves with pointed or rounded edges to promote ease and comfort in sleeping. The device may be an alternative to a baby swaddle device or accessory that is configured to act as a swaddle transitioning device or alternative. The effectiveness of the present device is not limited to just one arrangement. For example, the device may be configured to provide security and comfort to the infant in order to reduce the reflexive flailing (moro reflex) and habitual waking patterns that dominate their sleep cycles.

As seen in the figures, the sleep device 100 for an infant may include a garment 102 suitable for infant sleep and two sleeves 104 attached to the garment. The garment may include two arm openings 108, each operable to receive an arm of the infant. The sleeves 104 may be attached to the arm openings 108 of the garment 102 via an attachment mechanism 106. The weighted sleeves may be permanently attached or reversibly attached to the garment.

Figure 1F:
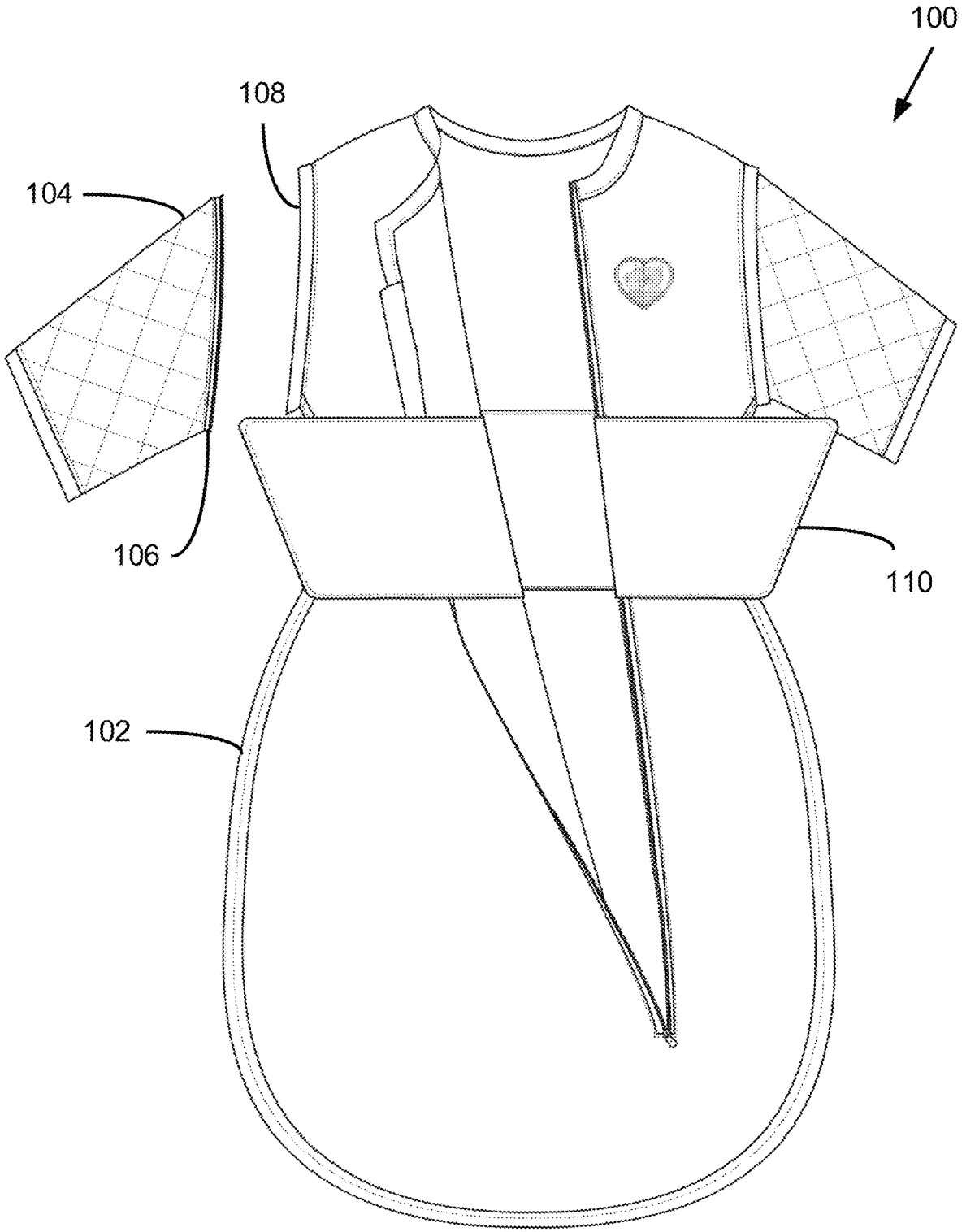
FIG. 1F is a view of the garment of FIG. 1E with a batwing attachment.
Figure 2A:
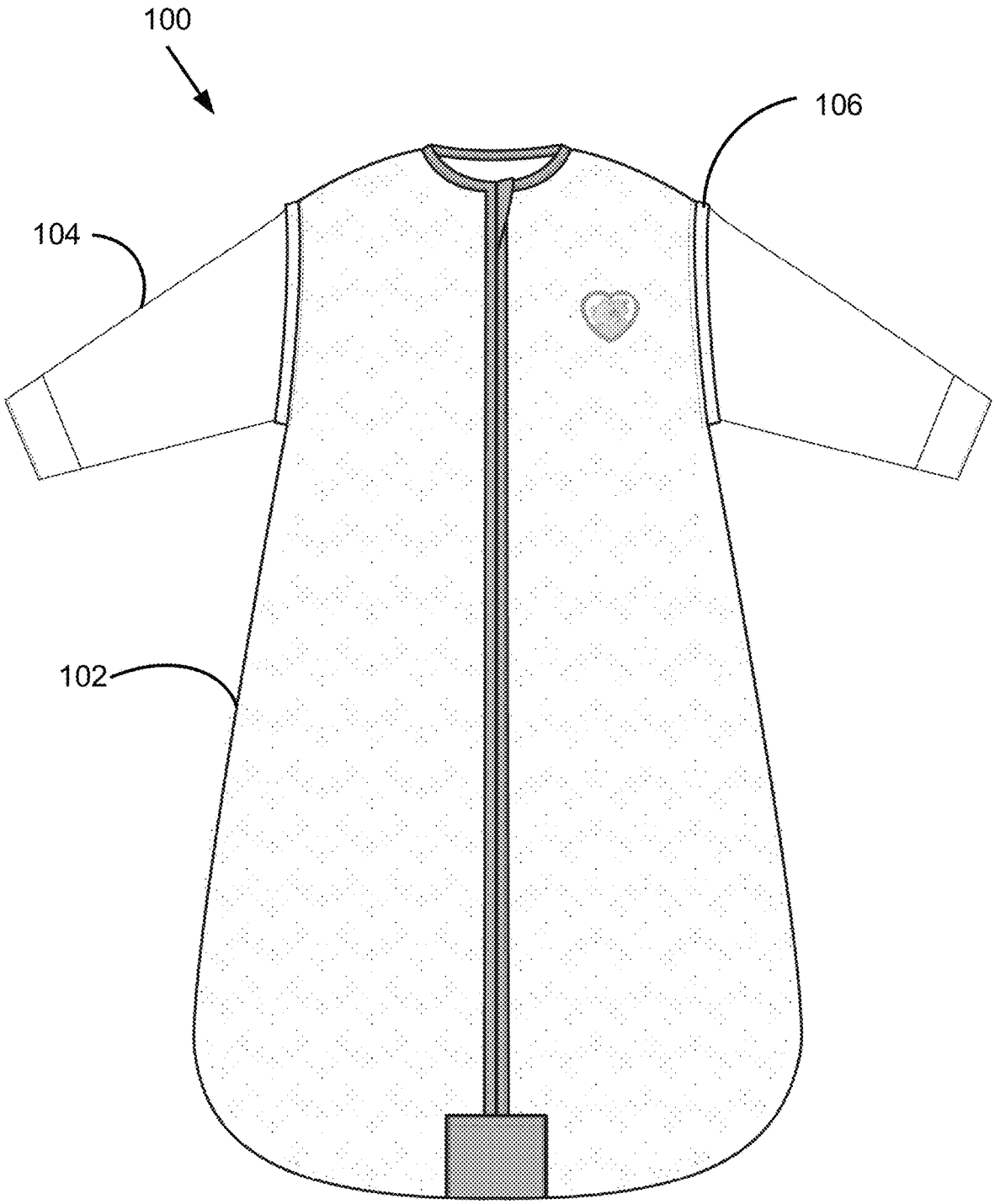
FIG. 2A is a view of the weighted sleeves with cuffs on a snug-fitting zippered swaddle garment, in an example.
Figure 2B:
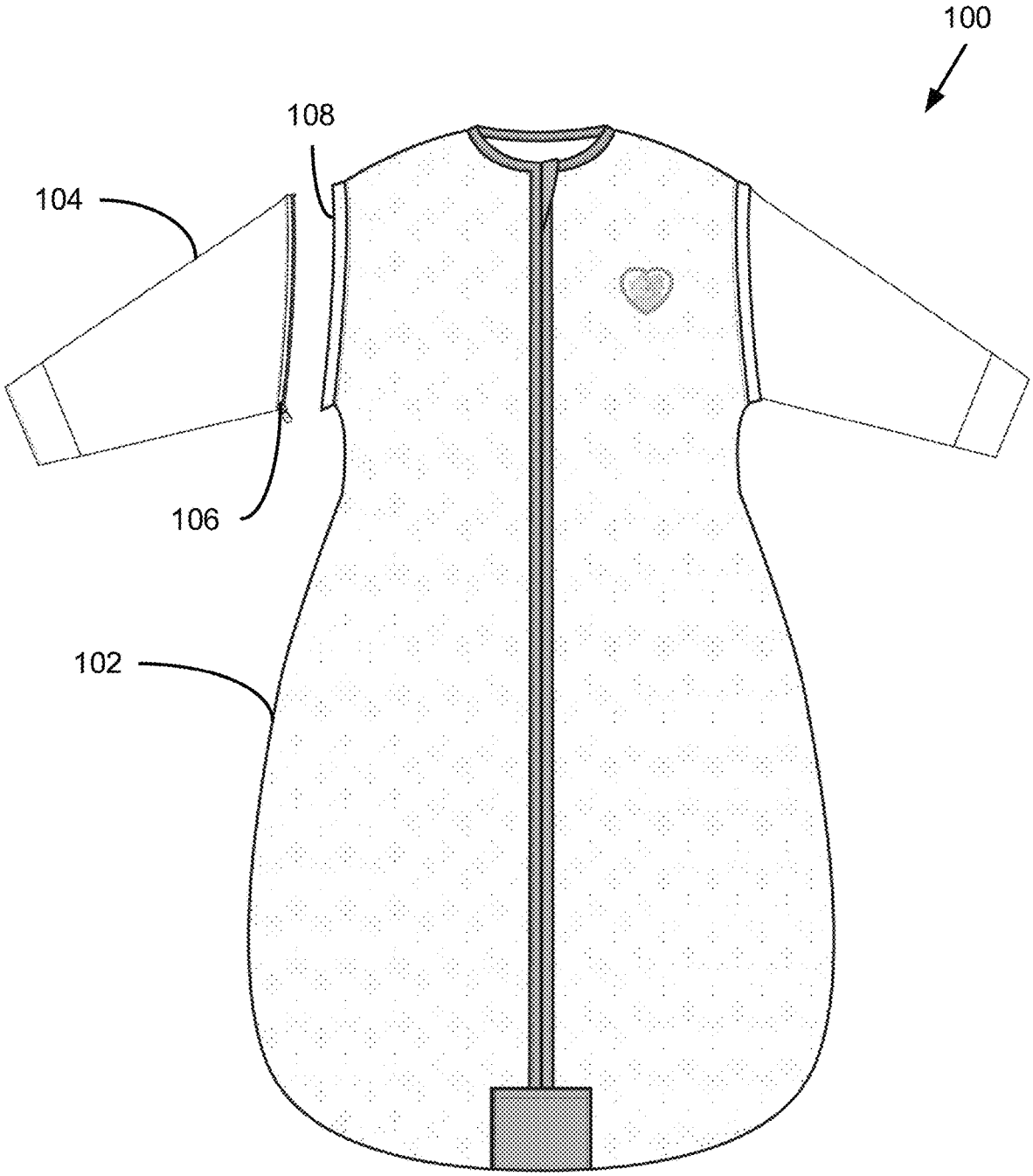
FIG. 2B is a view of the garment of FIG. 2A with a weighted sleeve removed.
Figure 2C:
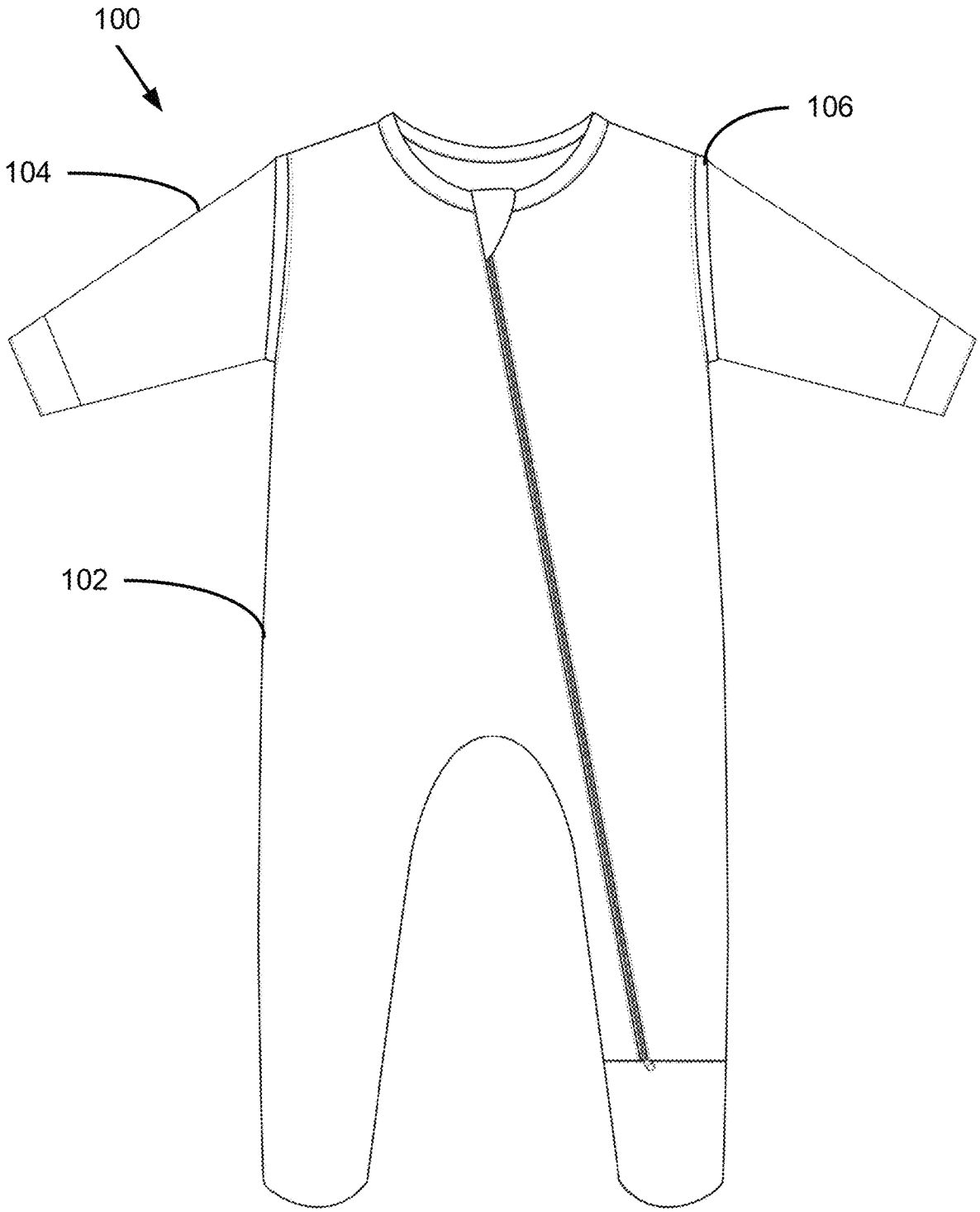
FIG. 2C is a view of the weighted sleeves with cuffs on a full-body pajama garment, in an example.
Figure 2D:
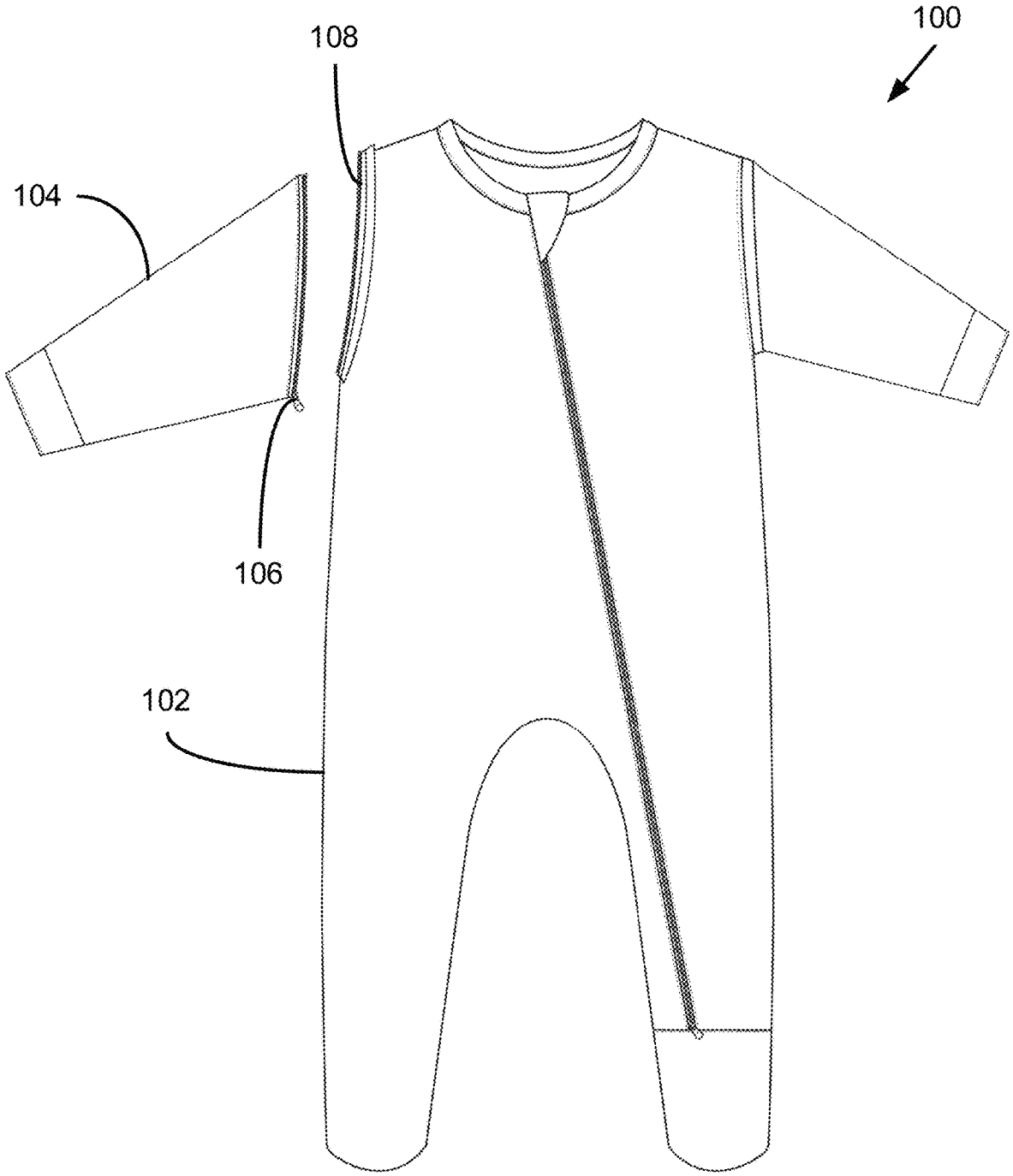
FIG. 2D is a view of the garment of FIG. 2C with a weighted sleeve removed.
Figure 2E:
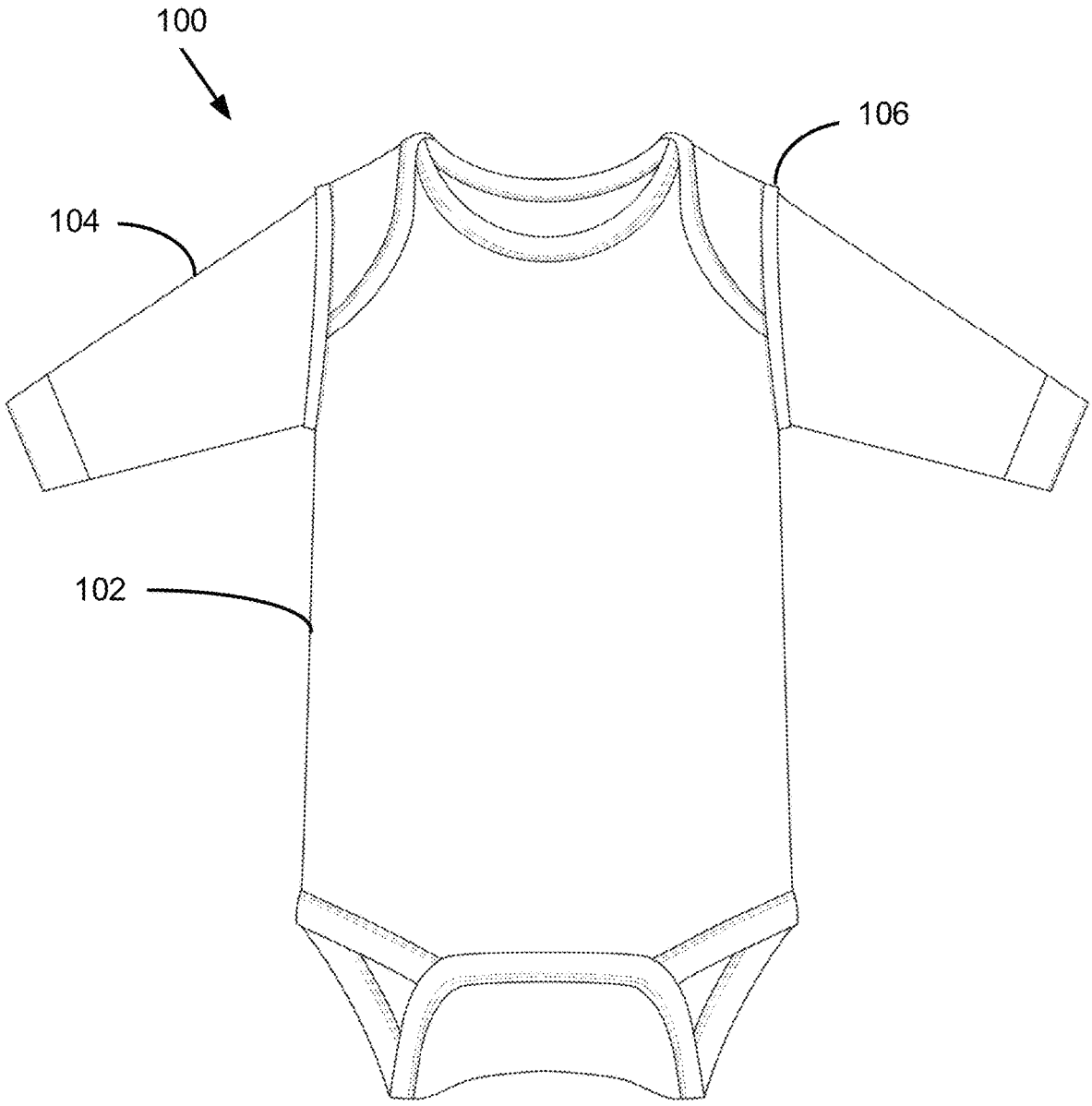
FIG. 2E is a view of the weighted sleeves with cuffs on a body suit garment, in an example.
Figure 2F:
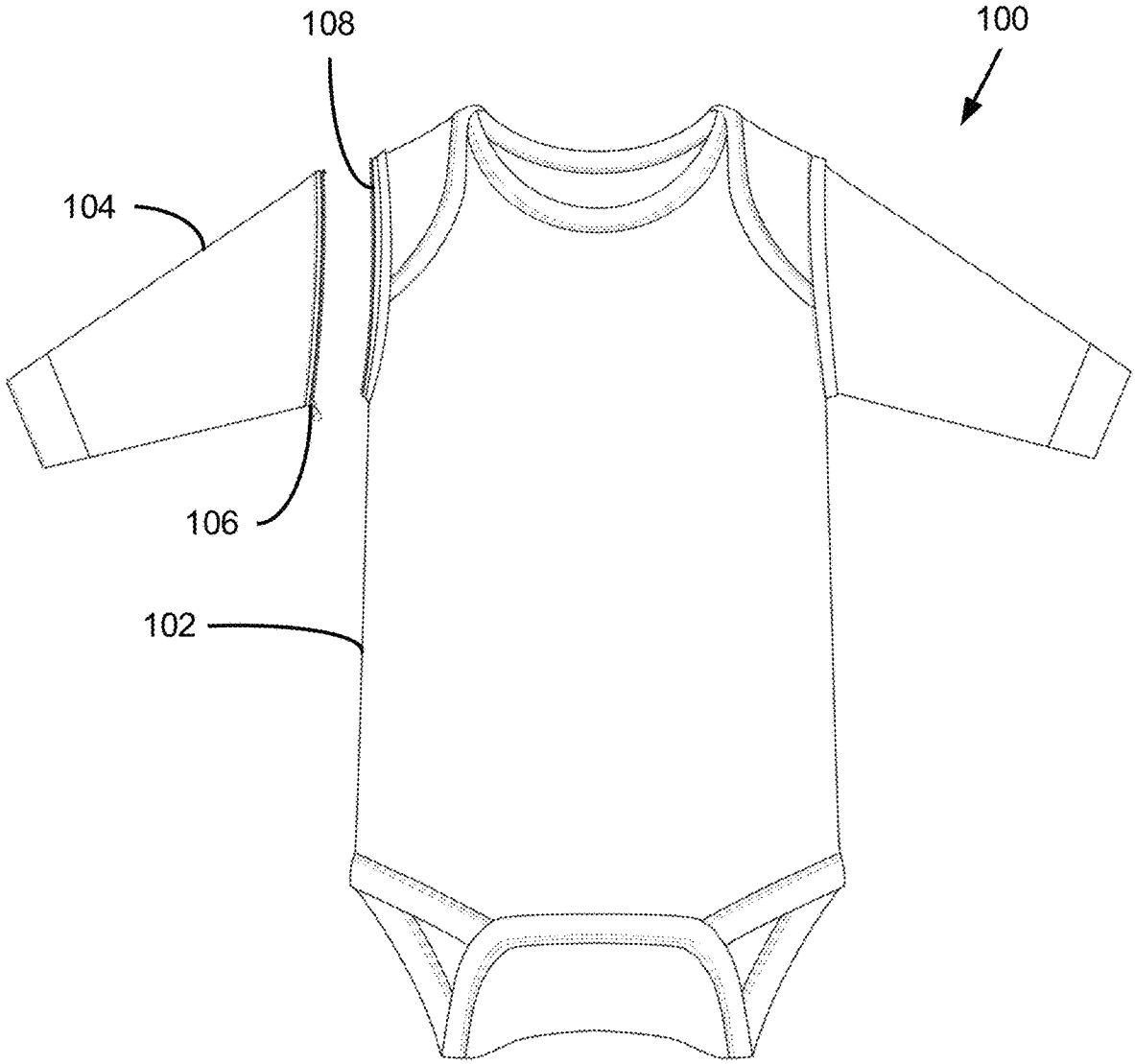
FIG. 2F is a view of the garment of FIG. 2E with a weighted sleeve removed.
Figure 3A:
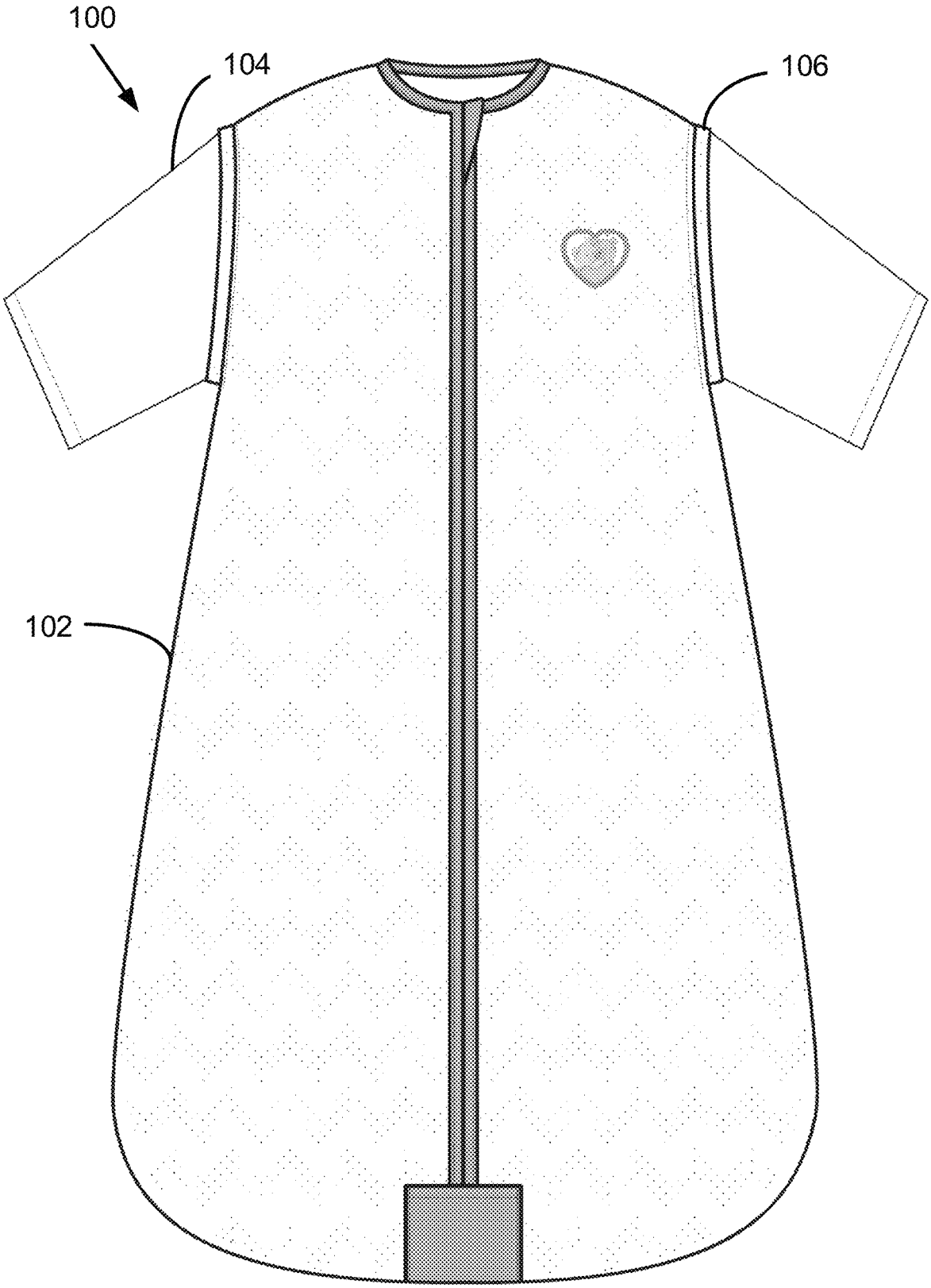
FIG. 3A is a view of the weighted sleeves with weighting between layers of fabric on a snug-fitting zippered swaddle garment, in an example.
Figure 3B:
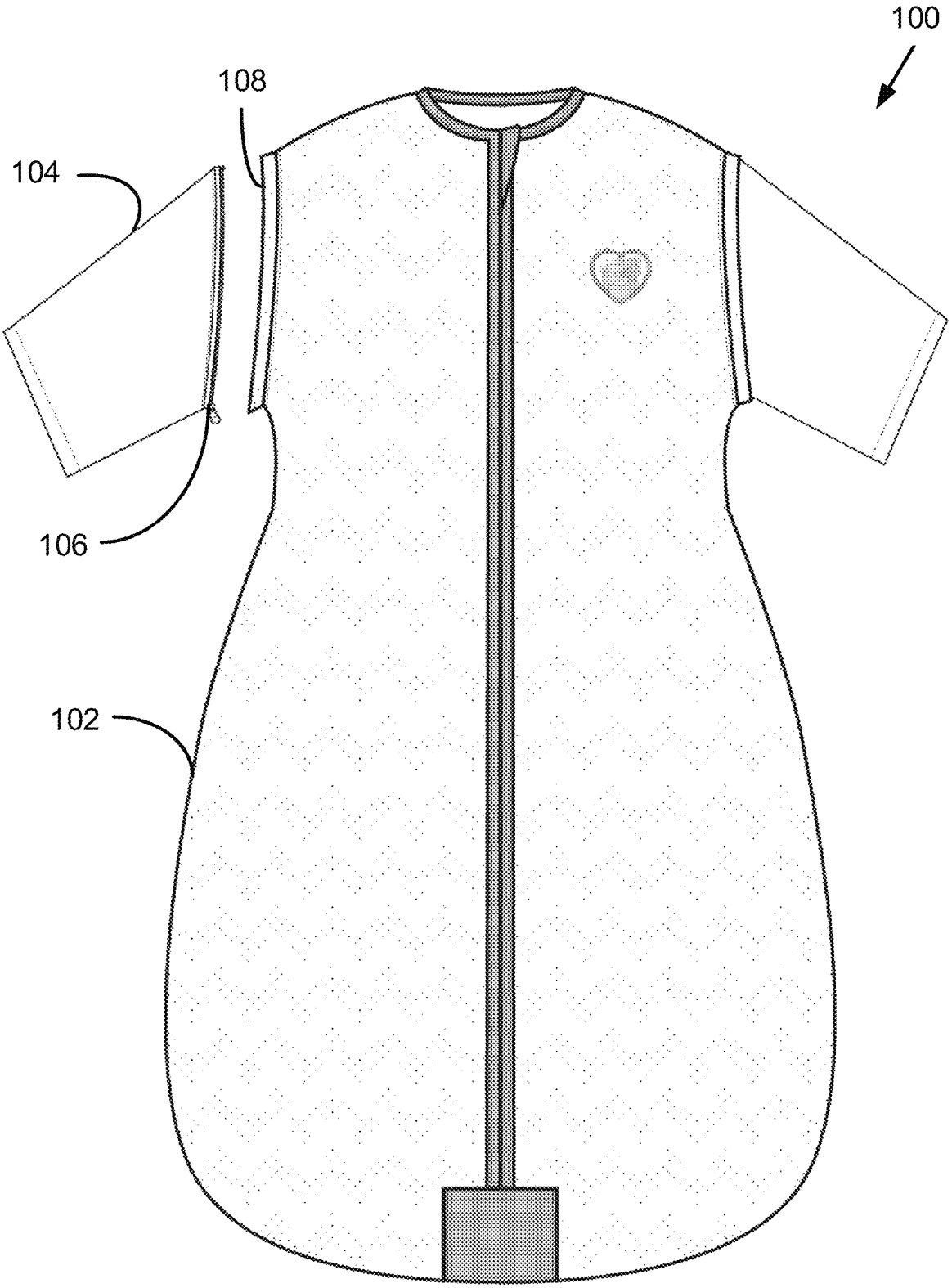
FIG. 3B is a view of the garment of FIG. 3A with a weighted sleeve removed.
Figure 3C:
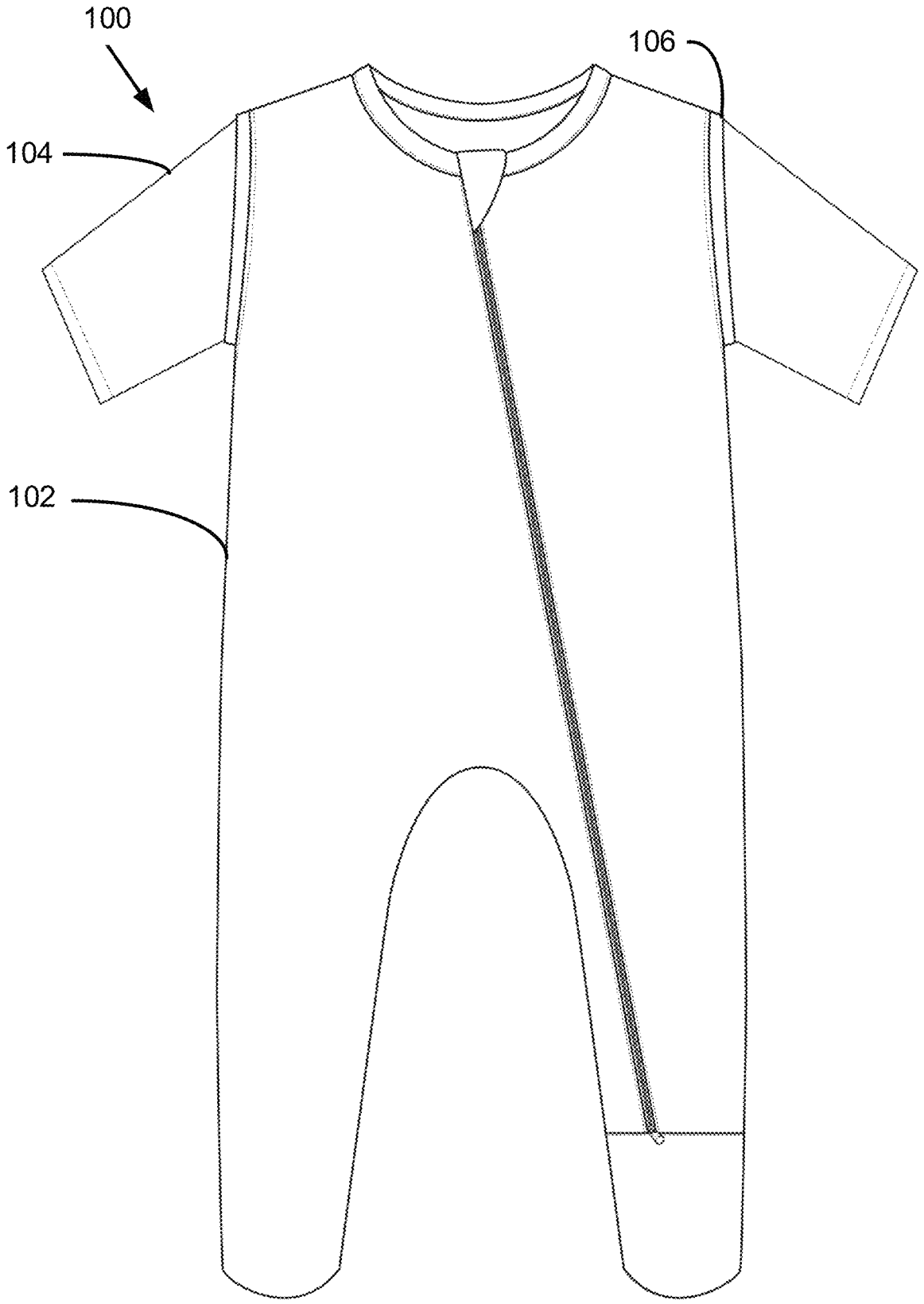
FIG. 3C is a view of the weighted sleeves with weighting between layers of fabric on a full-body pajama garment, in an example.
Figure 3D:
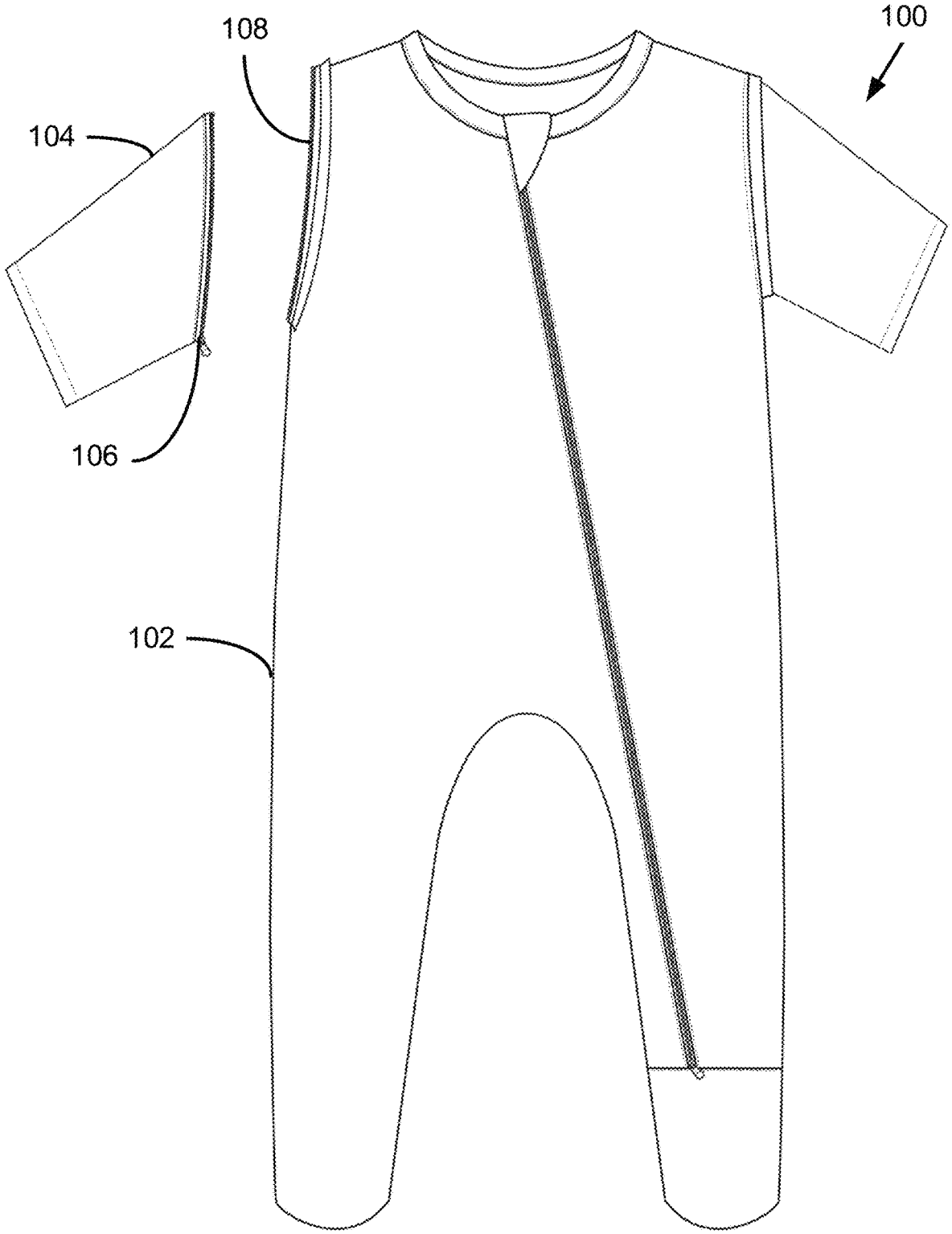
FIG. 3D is a view of the garment of FIG. 3C with a weighted sleeve removed.
Figure 3E:
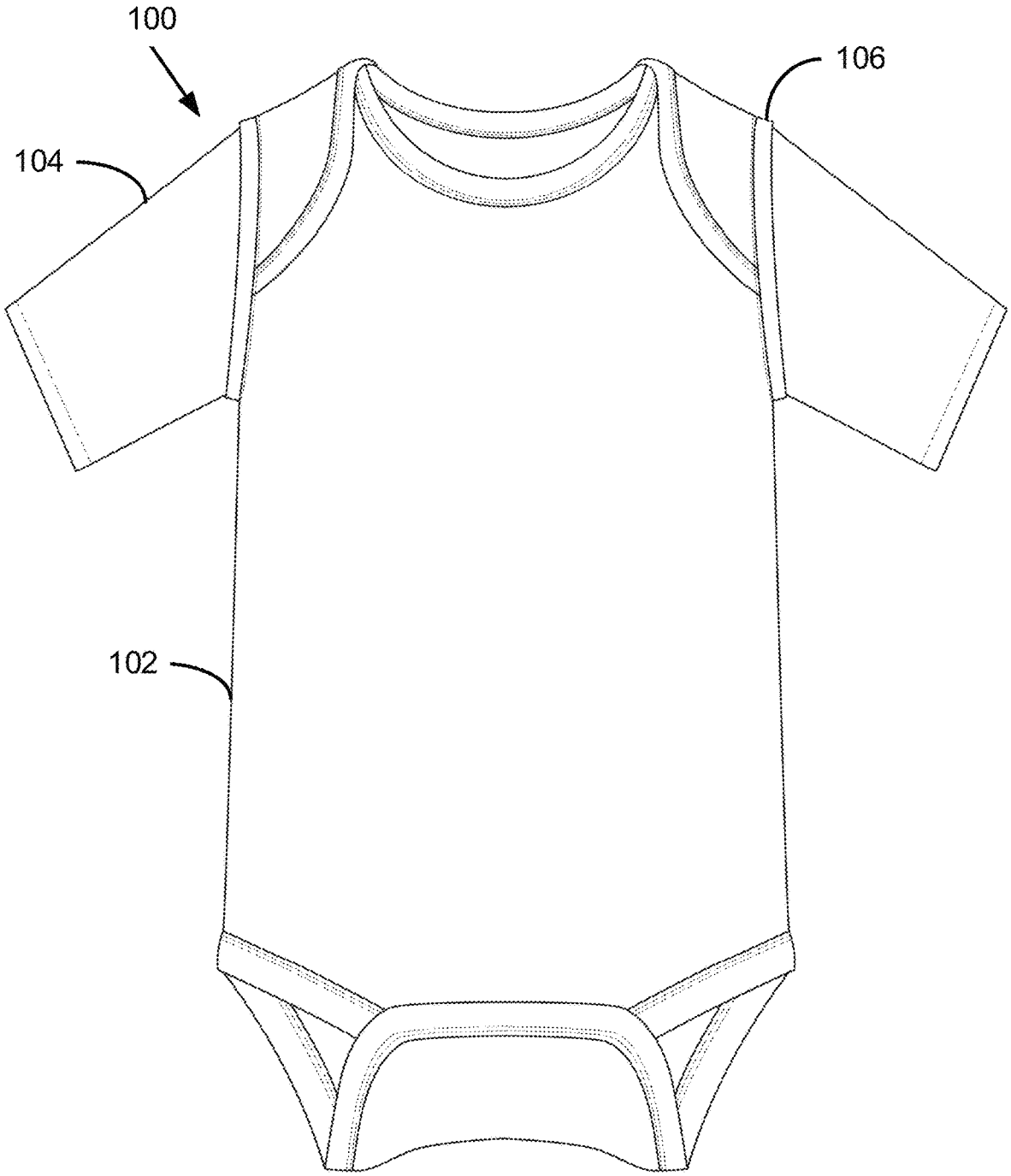
FIG. 3E is a view of the weighted sleeves with weighting between layers of fabric on a body suit garment, in an example.
Figure 3F:
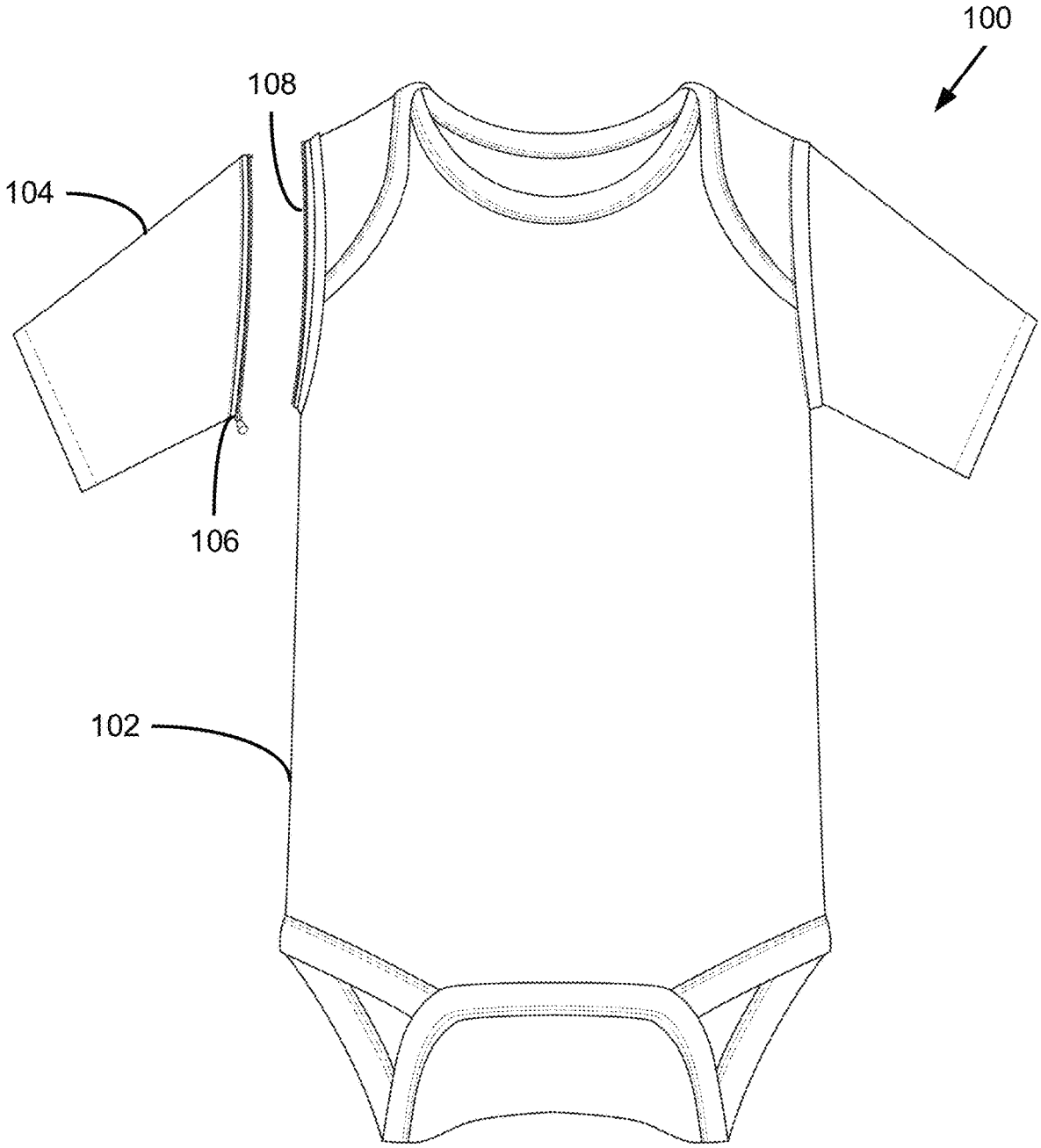
FIG. 3F is a view of the garment of FIG. 3E with a weighted sleeve removed.
Figure 4A:
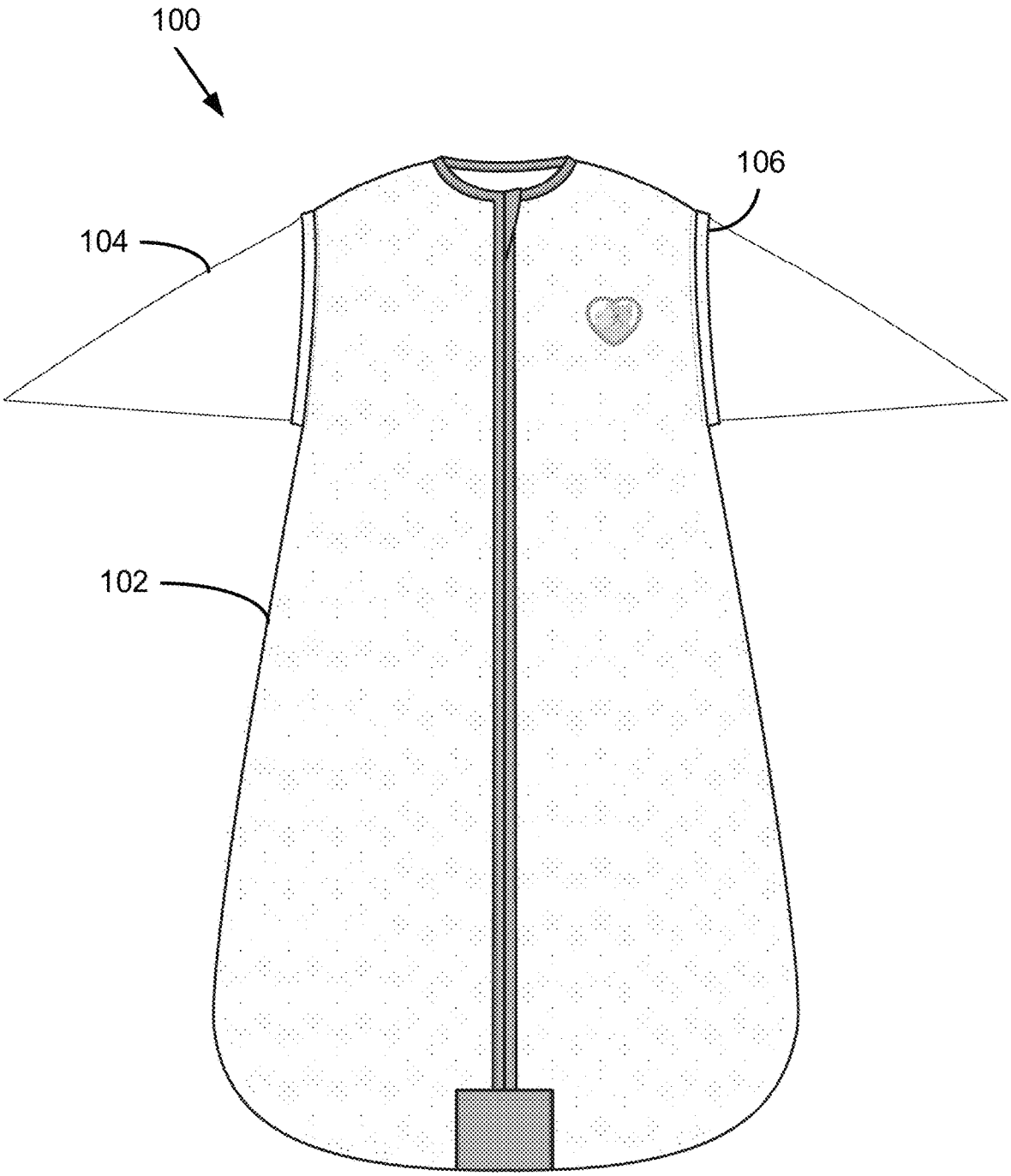
FIG. 4A is a view of triangle-shaped sleeves on a snug-fitting zippered swaddle garment, in an example.
Figure 4B:
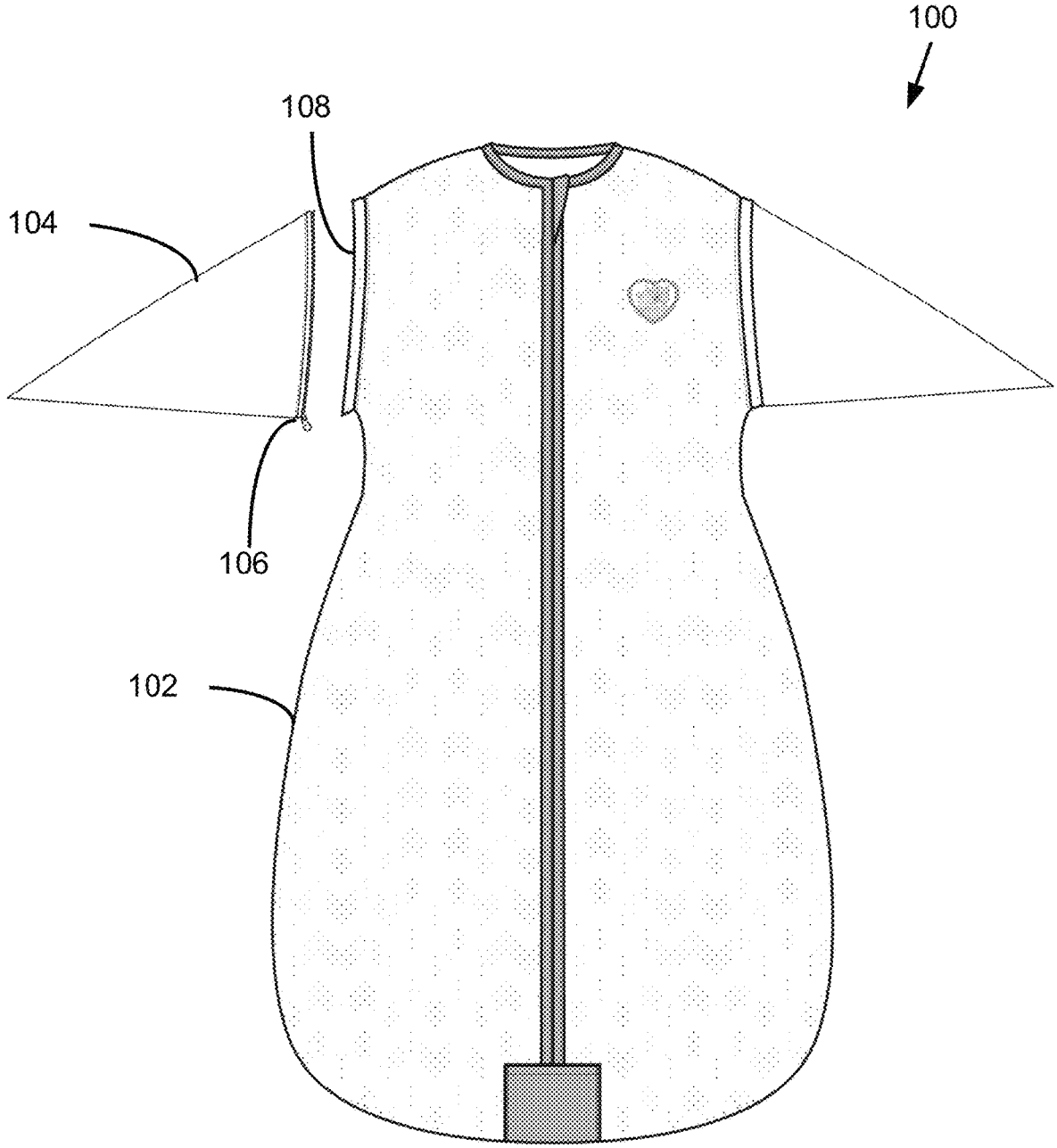
FIG. 4B is a view of the garment of FIG. 4A with a sleeve removed.
Figure 4C:
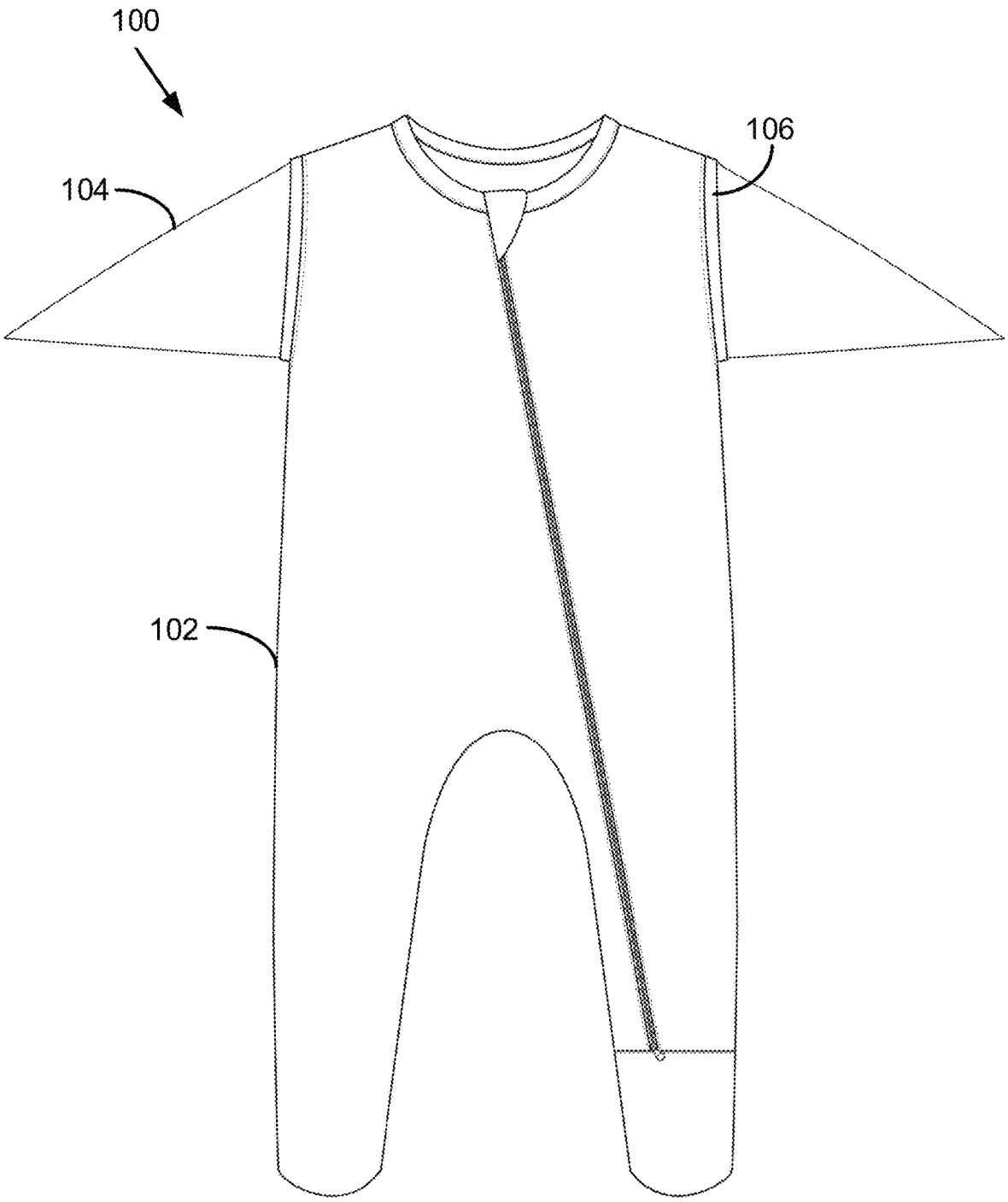
FIG. 4C is a view of triangle-shaped sleeves on a full-body pajama garment, in an example.
Figure 4D:
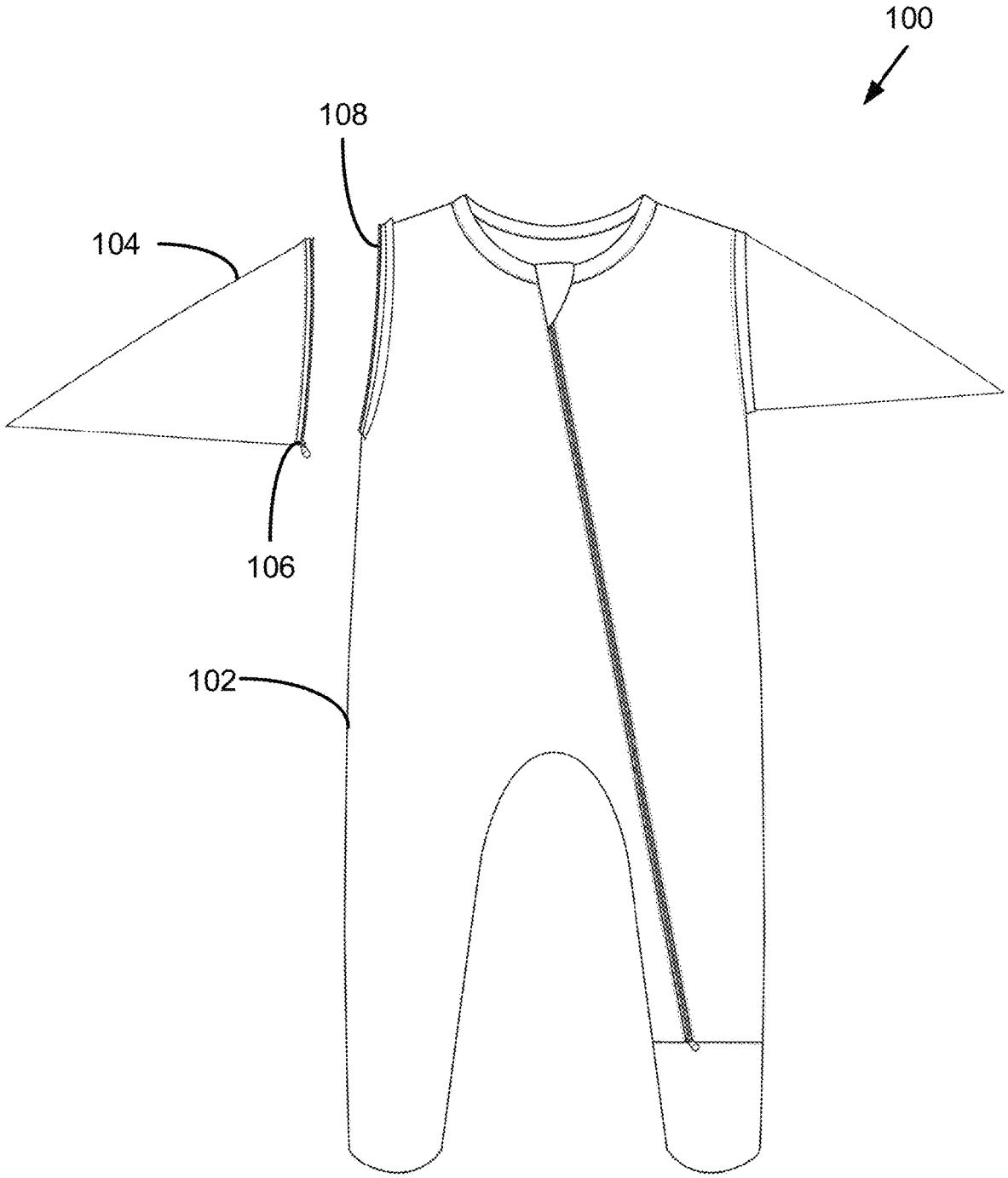
FIG. 4D is a view of the garment of FIG. 4C with a sleeve removed.
Figure 4E:
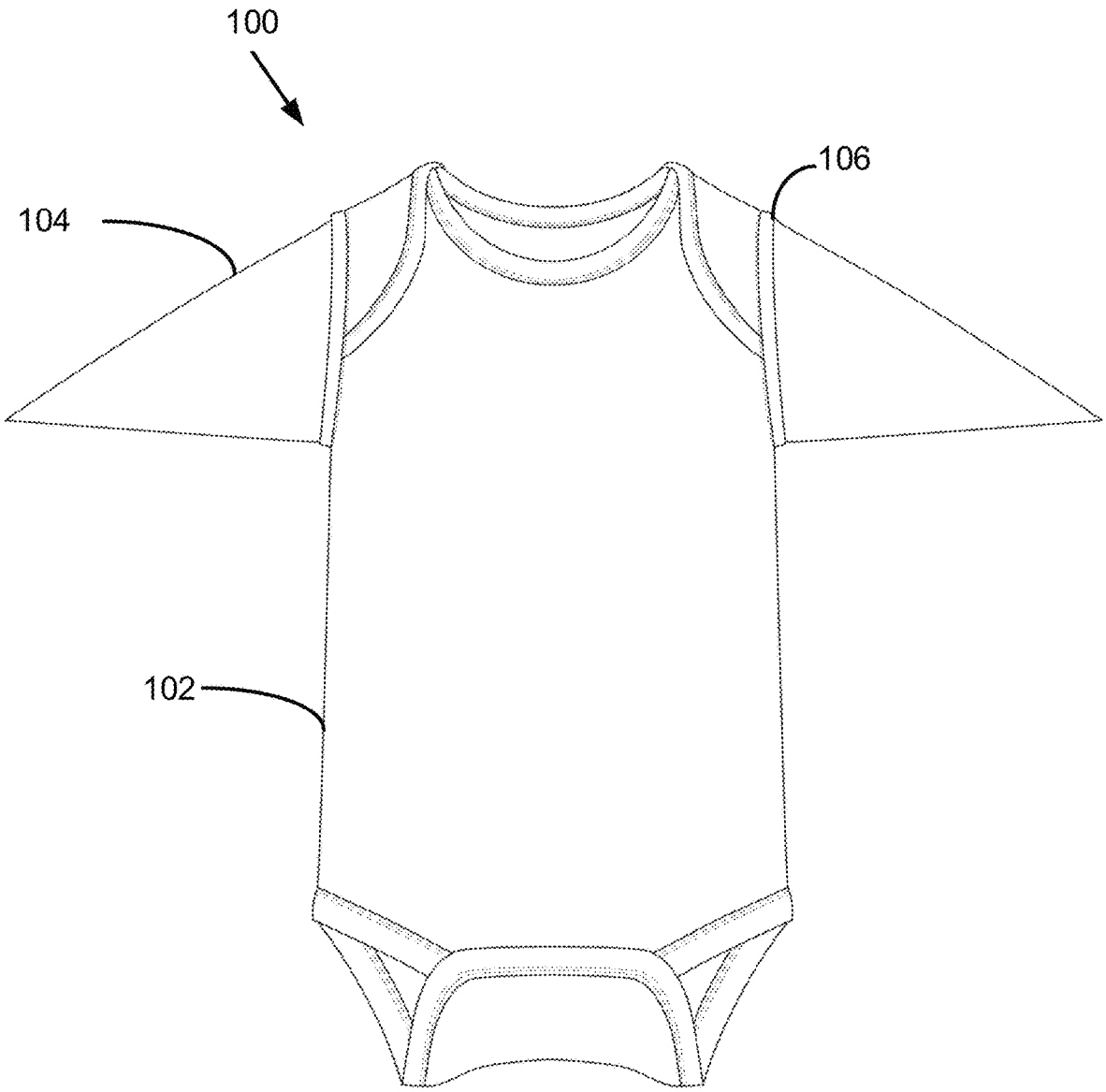
FIG. 4E is a view of triangle-shaped sleeves on a body suit garment, in an example.
Figure 4F:
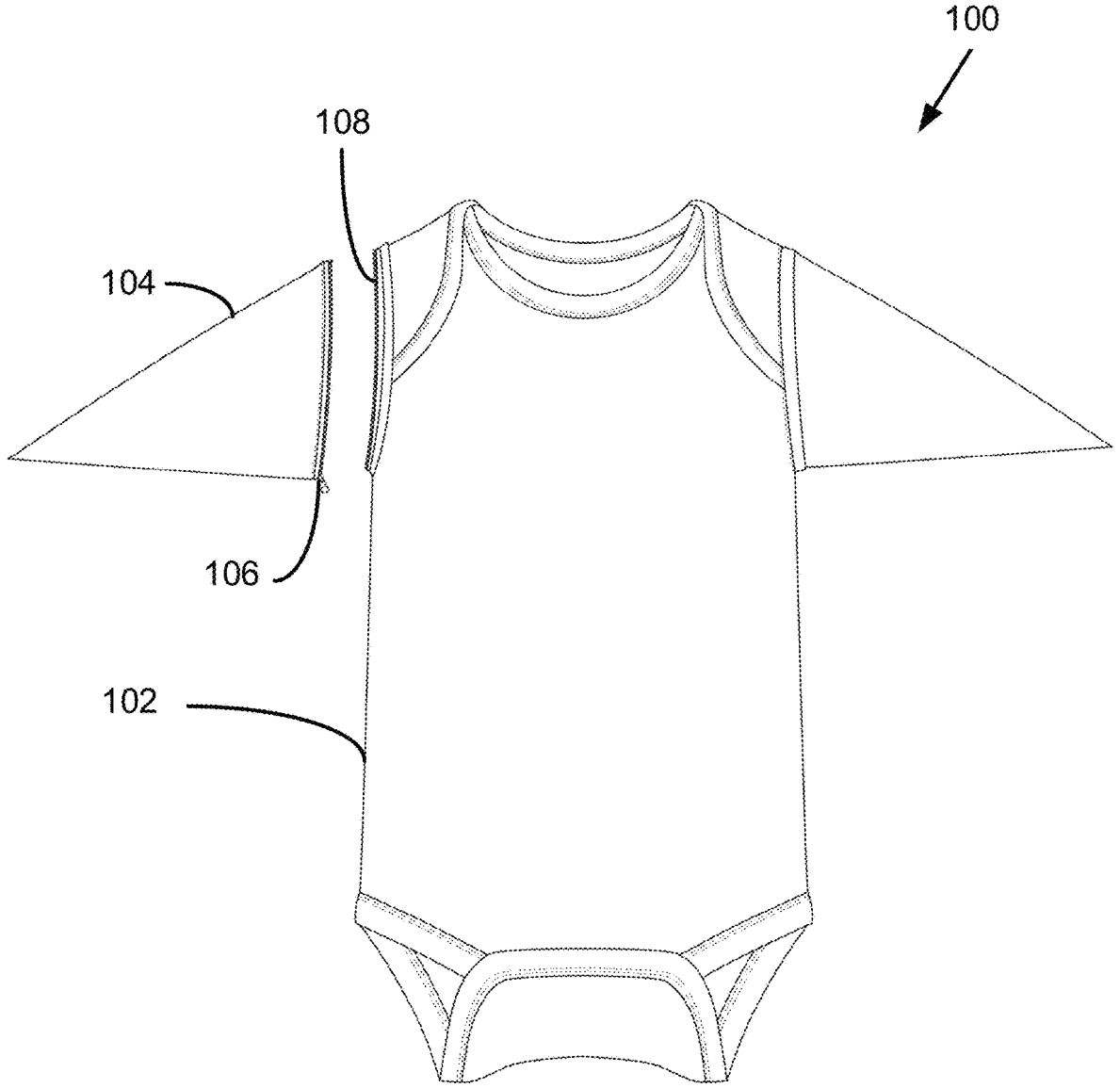
FIG. 4F is a view of the garment of FIG. 4E with a sleeve removed.

The garment may include but is not limited to a wearable blanket, a swaddle, or one or two-piece traditional infant sleepwear such as a body suit (e.g. FIGS. 1A, 2E, 3E and 4E), a onesie, pajamas, full-body pajamas (e.g. FIGS. 1C, 2C, 3C, and 4C), a zippered swaddle (e.g. FIGS. 1E, 2A, 3A and 4A), or any other garment that is safe, suitable, or traditionally used for infant or toddler sleep. The garment may be snug fitting on the infant, such as a sung-fitting swaddle. In an example, such as FIG. 1F, the garment may further include an attachment (a "batwing" attachment) 110 operable to surround the garment and further secure the garment to create a swaddle-like fit around the infant. The garment may include a front panel, a back panel, and a neck opening. In some examples, the bottom of the garment is enclosed to form a leg pouch. The front panel may include a zippered opening extending downward from a neck opening or a flap configured to conceal at least a portion of the zippered opening. In some examples, the zippered opening may include a dual two-way zipper. The garment may allow for the feet of the infant to be covered or uncovered.

The device may be made of a single piece of fabric or multiple layers of fabric. In some examples, the garment and/or sleeves may include 1, 2, 3, 4, 5, or 6 layers of fabric. In at least one example, the sleeves include 4 layers of fabric. The garment and the sleeves may include the same or different number of fabric layers. The fabric may be cotton, fleece, or any other similar fabric type or blend. In an example, the garment may be made of a single layer of fabric and the sleeves may be made of two or more layers of fabric.

The length of the sleeve may range from up to about 10 cm to about 15 cm. The width of the sleeve may range from up to about 5 cm to about 15 cm. In some examples, the width of the sleeve may be about 10.8 cm. For example, an upper edge of the sleeve is operable to rest just below the infant's armpit and a bottom edge of the sleeve is operable to rest just above the infant's wrist or just under the infant's elbow. The sleeve may extend in length substantially from the uppermost or the mid-periphery of the garment to the garment waistline.

In some embodiments, the arm openings in the garment may extend from the shoulder down to the infant or toddler's chest, so that there is bagginess or an extra or seemingly unnecessary portion of fabric leading into the arm opening to allow the child to have full range of movement but still be able to safely feel the edges of the sleeve for comfort and security.

In an embodiment, as seen in FIGS. 4A-4F, the sleeves may be triangle shaped and pointed at the end where the child's hand may rest to provide some resistance and help aid in reducing the baby's premature startles but still allow for full extension, contraction, and movement of the arm. The triangle shaped sleeves do not restrict movement of the infant's arms but only provide edges to mimic a womb-like environment to soothe the child's startles In some aspects, the triangle shaped sleeve may have an opening or slit by or at the wrist so the child may be able to leave their hand out of the sleeve for ventilation, self-soothing, or warmth. In some examples, the triangle sleeves may include a built in silicone teether or a pacifier at the end of pointed end. In another embodiment, as seen in FIGS. 2A-2F, the sleeves may further include a cuff at the wrist end to function as a fold-over mitten mechanism to cover the hand for added security, warmth, comfort, or to prevent scratches.

In an embodiment, the sleeves may be attached to openings in the garment through the use of an attachment mechanism for safety and durability. Non-limiting examples of the attachment mechanism include snaps, buttons, zippers, or hook-and-loop closure (Velcro). Each sleeve may be detachable from the arm openings in a bodice or torso portion of the garment, such that detaching a sleeve leaves the opening at a side of the garment, through which the infant can extend their arm out of the garment, as seen in FIGS. 2B, 2D, 3B, 3D, 3F, 4B, 4D, and 4F. The sleeves may be removed once the startle reflex decreases in intensity and the infant can still continue to wear the sleep garment to sleep. This allows for the same garment to be used at various sleep stages of the infant. In another embodiment, the sleeves may be non-removable from the garment.

In some embodiments, the sleeves of the sleep garment device may include weighting. The weighting in the sleeves may further encourage the feeling of security for infants by mimicking a swaddling environment to soothe the child's startle and involuntary reflexes. Weighted sections of the sleeves apply gentle pressure on the infant's arms and help to keep their arms lowered as is recommended for swaddling in the supine position. This way, when the neurological reflexive twitching occurs while the infant is sleeping, he is able to stay asleep and not wake up prematurely. In some examples, the weighted sleeves may allow full extension, contraction, and movement of the infant's arm.

The weighting may be accomplished by changing the thickness of the sleeve, the amount of fabric, and/or material used for weighting. In some examples, the sleeve may hold a thick, heavy weighting or a lighter weighting for insulation. In various examples, the weighting may be weighted material that is safe for use in children's clothing products, such as, but not limited to: poly-fill fiber or pellets, glass beads, poly beads, glass beans, beans, sand, bamboo beads, a polymeric gel, silicone, weighty fabric, or any other item that is acceptable for this purpose. In some examples, the weighting may be placed between two layers of fabric in the sleeve, as is FIGS. 3A-3F. In at least one example, the sleeve has four layers, with a weighting encased within the middle two layers. This may be done in order to continue to suppress the baby's moro reflex while still allowing for a slight increase in movement of the infant's arms, thus maximizing on comfort. In some embodiments, the garment is not operable to hold weighting, such that the weighting is only within the sleeves.

In some embodiments, the weighting of the weighted sleeves may include weighting within one or more subpanels or chambers. The sleeves may each include an array of more than one weighted subpanels or chambers. The subpanels or chambers may be connected to at least a portion of an outer surface of the sleeves. In an example, the subpanels or chambers may be in the form of quilting within two or more layers of the sleeve, as seen in FIGS. 1A-1D. In some examples, the weighting may be visible on the outside of the sleeves. In other embodiments, the weighting may be within individual chambers hidden inside the outer layer of fabric. The weighting in the sleeves may be only in an anterior portion of the sleeves, only in a posterior portion of the sleeves, or evenly distributed throughout the sleeves.

The weighted sleeves may have a weight ranging from about 1 oz to about 8 oz. For example, the weighted sleeves may have a weight of about 1 oz, about 2 oz, about 3 oz, about 4 oz, about 5 oz, about 6 oz, about 7 oz, or about 8 oz.

Also provided herein is a method of reducing startle reflexes of an infant. The lightly weighted sleeves prevent the baby's arms from unnecessarily moving about in an uncontrolled fashion and negatively hindering the previously established sleep patterns for healthy and developmentally appropriate sleep.

Although the invention described herein has been written about in detail, it should be appreciated that alterations, changes, and replacements may be made within the design without swaying from the original purpose and possibility of the invention in its most comprehensive arrangement. The illustrations provided are simply to be used as descriptors only and not restrictive in any manner, form, or purpose. Thus, other characterizing embodiments may be added to the design of the invention without straying from the fundamental characteristics mentioned herein. All such comparable embodiments and examples are within the spirit and scope of the invention discussed herein, are contemplated thereby, and proposed to be protected by the following claims.

What is claimed is:

1. A sleep device for an infant comprising:

a garment suitable for infant sleep having two arm openings, each operable for receiving an arm of the infant, wherein each of the two arm openings are operable to extend from a shoulder of the infant to a chest of the infant; and two sleeves attached to the arm openings of the garment, wherein the sleeves are detachable from the garment, wherein the sleeves are operable to surround the infant's arms such that the infant's elbows are positioned within the sleeves, wherein the sleeves are triangle-shaped such that each of the sleeves defines a first edge and a second edge when the sleeves are attached to the garment, the first edge configured to extend from the shoulder of the infant to a distal point, the second edge configured to extend from the chest of the infant to the distal point, the distal point operable to receive a hand of the infant, a first angle defined by the first edge and measured with respect to a horizontal axis being greater than a second angle defined by the second edge and measured with respect to the horizontal axis when the sleep device is oriented vertically, the first edge and the second edge mimicking a womb-like environment to soothe the infant's premature startles, wherein the second edge of each sleeve extends substantially parallel to the horizontal axis.

2. The sleep device of claim 1, wherein the sleeves are reversibly attached to the garment using a zipper, a hook-and-loop closure, buttons, or snaps.

3. The sleep device of claim 1, wherein the infant's arm extends out of the garment through the arm opening when a sleeve is detached from the garment.

4. The sleep device of claim 1, wherein the garment is selected from a wearable blanket, a sleep sack, a body suit, a onesie, pajamas, a swaddle, or any other garment that is safe and suitable for infant or toddler sleep.

5. The sleep device of claim 1, wherein the garment comprises a front panel and a back panel.

6. The sleep device of claim 5, wherein the front panel and back panel are single-layered or multi-layered.

7. The sleep device of claim 5, wherein the front panel comprises a zippered opening extending downward from a neck opening and a flap configured to conceal at least a portion of the zippered opening.

8. The sleep device of claim 1, wherein the sleeves provide resistance to reduce the infant's premature startles while allowing for full extension, contraction, and movement of the infant's arm.

9. A method of using a sleep device, the method comprising:

placing an infant inside the sleep device of claim 1, wherein the sleeves are operable to provide some resistance and help aid in reducing the infant's premature startles.

10. The method of claim 9, wherein the sleeves allow for full extension, contraction, and movement of the arm.

11. The method of claim 9, further comprising removing at least one sleeve from the garment using an attachment mechanism.

* * * * *